US006428201B1

(12) United States Patent
Shibuya et al.

(10) Patent No.: US 6,428,201 B1
(45) Date of Patent: Aug. 6, 2002

(54) CHRONOGRAPH TIMEPIECE AND LEVER DEVICE FOR TIMEPIECE

(75) Inventors: Norio Shibuya; Takashi Takahashi; Mamoru Watanabe, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/582,015

(22) PCT Filed: Dec. 22, 1998

(86) PCT No.: PCT/JP98/05787

§ 371 (c)(1),
(2), (4) Date: Oct. 10, 2000

(87) PCT Pub. No.: WO99/32943

PCT Pub. Date: Jul. 1, 1999

(30) Foreign Application Priority Data

Dec. 22, 1997 (JP) ..... 9-353621

(51) Int. Cl.[7] ..... G04F 27/00
(52) U.S. Cl. ..... 368/106
(58) Field of Search ..... 368/140, 185, 368/106

(56) References Cited

U.S. PATENT DOCUMENTS 4,588,305 A * 5/1986 Piguet et al. ..... 368/185
5,793,708 A * 8/1998 Schmidt et al. ..... 368/106

FOREIGN PATENT DOCUMENTS

| | | |
|---|---|---|
| CH | 0003818 | 12/1891 |
| JP | 63060984 | 4/1988 |
| JP | 9178868 | 7/1997 |

* cited by examiner

*Primary Examiner*—Bernard Roskoski
(74) *Attorney, Agent, or Firm*—Adams & Wilks

(57) ABSTRACT

In a state in which a chronograph mechanism is not operated, a coupling lever 442 positions a second counting transmission pinion 212*b* such that the second counting transmission pinion 212*b* is separated from a second chronograph wheel 214. In a state in which the chronograph mechanism is operated, the coupling lever 442 is moved to rotate such that the chronograph mechanism is operated. As a result, the second counting transmission pinion 212*b* is in mesh with the second counting wheel 214. By bringing an outer peripheral portion 442*f* of a guide frame 442*d* into contact with a contact portion 202*d* of a chronograph bridge 202, movement of the coupling lever 442 is set.

33 Claims, 32 Drawing Sheets

CHRONOGRAPH TIMEPIECE AND LEVER DEVICE FOR TIMEPIECE

BACKGROUND OF THE INVENTION

2. Field of the Invention

The present invention relates to a chronograph time piece, particularly to a chronograph time piece for measuring "hour", "minute" and "second" and displaying respective results of measurement by a chronograph hour hand, a chronograph minute hand and a chronograph second hand.

Further, the invention relates to a lever apparatus for a time piece, particularly to a lever apparatus suitable for executing start/stop operation and reset operation of a chronograph time piece.

2. Background Information

In reference to FIG. 32, according to a conventional chronograph time piece, a barrel complete 110 rotates a front wheel train 312. A mainspring (not illustrated) is arranged in the barrel complete 110 and constitutes a power source of the chronograph time piece. A barrel pinion 912 is attached to the barrel complete 110 via a barrel complete slip mechanism 910. An hour counter intermediate wheel 914 is integrated to rotate by rotation of the barrel pinion 912. An hour counting gear 916 is integrated to rotate by rotation of the hour counter intermediate wheel 914. An hour counting wheel stem 920 is attached to the hour counting gear 916 via an hour counting slip mechanism 918 and by a chronograph hour hand 128 attached to the hour counting wheel stem 920, there is displayed a result of measurement of an elapse time period of "hour" such as an elapse of 1 hour.

A second counting train wheel 316 is integrated to rotate by rotation of the front train wheel 312. A second counting wheel stem 934 is connected to the second counting train wheel 316 via a second counting slip mechanism 932. By a chronograph second hand 118 attached to the second counting wheel stem 934, there is displayed a result of measurement of an elapse time period of "second" such as an elapse of 1 second.

A minute counting wheel train 940 is integrated to rotate by rotation of the second counting wheel train 316. A minute counting wheel stem 944 is connected to the minute counting wheel train 940 via a minute counting slip mechanism 942. By a chronograph minute hand 124 attached to the minute counting stem 944, there is displayed a result of measurement of an elapse time period of "minute" such as an elapse of 1 minute. Transmission of rotation from the second counting wheel train 316 to the minute counting wheel train 322 is constituted to carry out via a pivoting wheel (not illustrated).

According to such a conventional chronograph time piece, the hour counting slip mechanism 918, the second counting slip mechanism 932 and the minute counting slip mechanism 942 are constituted to include clutch springs. Further, by operating the clutch springs, operation of the counting wheel trains is constituted to control.

Further, according to the conventional chronograph time piece, in pushing a button for starting/stopping the chronograph time piece, there is used an operating lever operated by the button. Further, a line spring is used for positioning the operating lever and by bending a portion of the operating lever, the line spring is hooked to the bent portion.

In zeroing the chronograph hands by pushing a reset button, a hammer is operated by a plate spring.

Further, according to the conventional chronograph time piece, there is provided a cam subjected to operation of a yoke for controlling to start and stop operation and zeroing of the chronograph and the cam is constituted to control various functions of the chronograph.

For example, there is disclosed a constitution of a conventional chronograph in Japanese Patent Laid-Open No. 9463/1975 and Japanese Patent Laid-Open No. 9464/1975.

However, the conventional chronograph time piece suffers from the following problems.

(1) The hour counting slip mechanism, the second counting slip mechanism and the minute counting slip mechanism are constituted to include the clutch springs and accordingly, a number of parts constituting the counting mechanisms is large and the structure of the time piece is complicated.

(2) It is difficult to position and integrate the operating lever operated by the start/stop button for starting/stopping the chronograph time piece when the start/stop button is pushed. Particularly, the line spring is used for positioning the operating lever and accordingly, it is difficult to adjust a degree of bending the line spring.

(3) According to the chronograph time piece in which an operational amount of the hammer is large, an amount of bending a spring for operating the hammer must be increased. Therefore, it is necessary that the spring for operating the hammer is large and long and a size of the movement needs to be large.

In order to resolve such conventional problems, the following are objects according to the invention.

(1) To provide a chronograph time piece in which a mechanism constituting the chronograph time piece needs not to adjust when integrating the chronograph time piece.

(2) To provide a small-sized chronograph time piece using a lever having excellent spring characteristic without using the clutch spring.

(3) To provide a lever apparatus for a time piece capable of operating a plurality of levers with certainty.

SUMMARY OF THE INVENTION

In order to resolve the above-described problems, according to an aspect of the invention, there is provided a chronograph time piece comprising a front train wheel rotating based on rotation of a barrel complete, a second counting wheel constituted to rotate based on rotation of the front train wheel in a chronograph measurement mode, a chronograph second display member for displaying a result of measurement of an elapse time period of second based on rotation of the second counting wheel in the chronograph measurement mode, and a coupling lever for preventing the rotation of the front train wheel from being transmitted to the second counting wheel in a mode in which the chronograph measurement is not executed and transmitting the rotation of the front train wheel to the second counting wheel in the chronograph measurement mode.

Further, according to another aspect of the invention, there is provided a chronograph time piece comprising a front train wheel rotating based on rotation of the barrel complete, a second counter intermediate wheel rotating based on rotation of the front train wheel, a chronograph second display member for displaying a result of measurement of an elapse time period of second based on rotation of the second chronograph wheel, a second counting wheel rotating based on rotation of the second counter intermediate wheel in a chronograph measurement mode, the chronograph second display member for displaying the result of measurement of the elapse time period of second based on the rotation of the second counting wheel, and a coupling lever for preventing the rotation of the second counter intermediate wheel from being transmitted to the second counting wheel in a mode in which chronograph measurement is not executed and transmitting the rotation of the second counter intermediate wheel to the second counting wheel in the chronograph measurement mode.

Further, according to another aspect of the invention, it is preferable to provide the chronograph time piece comprising a minute counting train wheel provided to rotate based on rotation of the second counting wheel, and a chronograph minute display member for displaying a result of measurement of an elapse time period of minute based on rotation of the minute counting train wheel.

Further, according to another aspect of the invention, it is preferable to provide the chronograph time piece comprising at least one hour counting train wheel provided to rotate based on the rotation of the barrel complete in the chronograph measurement mode, and a chronograph hour display member for displaying a result of measurement of an elapse time period of hour based on rotation of the hour counting train wheel.

Further, according to another aspect of the invention, there is provided the chronograph time piece comprising a center wheel & pinion provided to rotate based on the rotation of the barrel complete, a third wheel & pinion provided to rotate based on rotation of the center wheel & pinion, a second wheel provided to rotate based on rotation of the third wheel & pinion, a second display member rotating based on rotation of the second wheel for displaying second, a minute transmission pinion provided to rotate based on rotation of the center wheel & pinion, a minute drive wheel provided to rotate based on rotation of the minute transmission pinion, a minute display member rotating based on rotation of the minute drive wheel for displaying minute, an hour wheel provided to rotate based on the rotation of the minute transmission pinion, and an hour display member rotating based on rotation of the hour wheel for displaying hour.

By constructing the constitution in this way, the number of parts of the chronograph time piece can be reduced while the second counting wheel, the minute counting train wheel and the hour counting train wheel can be operated efficiently.

Further, according to another aspect of the invention, it is preferable to provide the chronograph time piece comprising a chronograph bridge for rotatably supporting an upper shaft portion of the second counting wheel, wherein the coupling lever rotatably supports the upper shaft portion of the counter intermediate wheel, and in the mode in which the chronograph measurement is not executed, the coupling lever is not brought into contact with the chronograph bridge and in the chronograph measurement mode, a portion of the coupling lever is brought into contact with the chronograph bridge.

By the foregoing construction, a meshing operation of the counting train wheel and release of mesh thereof can be controlled without using a clutch spring and the thickness of the counting train wheel can be reduced.

Further, according to another aspect of the invention, it is preferable to provide the chronograph time piece, wherein a guide frame (442*d*) is provided in the coupling lever (442) and the guide frame rotatably supports the upper shaft portion of the counter intermediate wheel, and in the chronograph measurement mode, an outer peripheral portion of the guide frame is brought into contact with the chronograph bridge to thereby determine a position of the coupling lever relative to the chronograph bridge, to thereby bring the counter intermediate wheel and the second counting wheel in mesh with each other.

By the foregoing construction, the state of the counter intermediate wheel and the second counting wheel in mesh with each other can be maintained with certainty.

Further, according to another aspect of the invention, there is provided a chronograph time piece comprising a main plate constituting a base plate of the chronograph time piece, a second counting wheel for measuring an elapse time period of second based on rotation of a barrel complete in a chronograph measurement mode, a minute counting train wheel for measuring an elapse time period of minute based on the rotation of the barrel complete in the chronograph measurement mode, hour counting train wheels for measuring an elapse time period of hour based on the rotation of the barrel complete in the chronograph measurement mode, a chronograph second display member for displaying a result of measurement of the elapse time period of second by rotating the second counting wheel, a chronograph minute display member for displaying a result of measurement of the elapse time period of minute by rotating the minute counting train wheel, a chronograph hour display member for displaying a result of measurement of the elapse time period of hour by rotating the hour counting train wheels, an operating lever provided movably to the main plate, and an operating cam rotating in one direction based on slidable movement of the operating lever, wherein the operating cam includes ratchet teeth and drive teeth, a number of teeth of the ratchet teeth is twice as much as a number of teeth of the drive teeth and the operating lever is provided engageably to the ratchet teeth, further comprising a stop lever constituted to be capable of stopping rotation of the second counting wheel by rotating the drive teeth in a mode in which chronograph measurement is not executed.

Further, according to another aspect of the invention, it is preferable to provide the chronograph time piece further comprising a second counter intermediate wheel rotating based on the rotation of the barrel complete, the second counting wheel rotating based on rotation of the second counter intermediate wheel in the chronograph measurement mode, the chronograph second display member for displaying the result of measurement of the elapse time period of second based on the rotation of the second counting wheel, and a coupling lever for preventing the rotation of the second counter intermediate wheel from being transmitted to the second counting wheel in the mode in which the chronograph measurement is not executed and transmitting the rotation of the second counter intermediate wheel to the second counting wheel in the chronograph measurement mode, wherein the coupling lever is operated by operating a stop lever.

Furthermore, according to another aspect of the invention, it is preferable to provide the chronograph time piece comprising an hour coupling operation lever rotated by rotating the stop lever, and an hour coupling lever rotating by rotating the hour coupling operation lever, wherein in the mode in which the chronograph measurement is not executed, the hour coupling lever sets rotation of a gear constituting the hour counting train wheel and in the chronograph measurement mode, the hour coupling lever permits the rotation of the gear constituting the hour counting train wheel.

By the foregoing construction, coupling operation of the chronograph time piece can be carried out with certainty by a small number of parts. Further, the respective levers used in the chronograph mechanism according to the invention, does not need a line spring.

Further, according to another aspect of the invention, it is preferable to provide the chronograph time piece, wherein the hour coupling operation lever is arranged on one side of the main plate, the hour coupling lever is arranged on other side of the main plate, further comprising an hour coupling operation lever operating pin provided to penetrate from the one side of the main plate to the other side of the main plate and provided at the hour coupling operation lever, and by moving the hour coupling operation lever operating pin, operation of the hour coupling operation lever is transmitted to the hour coupling lever.

Further, according to another aspect of the invention, it is preferable to provide the chronograph time piece further comprising a hammer transmission lever provided rotatably for resetting the chronograph time piece in reset operation, a hammer setting lever constituted to rotate by rotating the hammer transmission lever in the reset operation and a hammer constituted to rotate by rotating the hammer transmission lever for returning the chronograph second display member and the chronograph minute display member to zero.

Further, according to another aspect of the invention, it is preferable to provide the chronograph time piece comprising an hour hammer transmission lever provided rotatably for resetting the chronograph time piece in the reset operation, and an hour hammer constituted to rotate by rotating the hour hammer transmission lever for returning the chronograph hour display member to zero.

Furthermore, according to another aspect of the invention, it is preferable to provide the chronograph time piece comprising the hour hammer transmission lever provided rotatably for resetting the chronograph time piece in the reset operation, and an hour coupling lever constituted to rotate by rotating the hour hammer transmission lever in the reset operation, wherein in the reset operation, the hour coupling operation lever is constituted to rotate by rotating the hour coupling lever, in the reset operation, the hour coupling operation lever is constituted to rotate by rotating the hour coupling lever, the stop lever is rotated by rotating the hour coupling operation lever and is released of engagement with the second counting wheel.

By the foregoing construction, operation of resetting the chronograph time piece can be carried out with certainty.

Further, it is preferable to constitute to control operation of the hammer setting lever and the stop lever by rotating the drive teeth of the operating cam.

By the foregoing construction, positions of the plurality of levers in the rotational direction for controlling operation of resetting the chronograph time piece can be determined with certainty.

Further, according to another aspect of the invention, it is preferable to provide the chronograph time piece wherein in the reset operation, release of the engagement of the stop lever with the second counting wheel is executed prior to the operation of returning the chronograph second display member and the chronograph minute display member to zero by the hammer.

By the foregoing construction, the chronograph second display member and the chronograph minute display member can be returned to zero with certainty with no influence by the force of the stop lever.

Further, according to another aspect of the invention, there is provided a lever apparatus for a time piece comprising an operating lever provided movably to a main plate of the time piece and an operating cam rotating in one direction based on slidable movement of the operating lever, wherein the operating cam includes ratchet teeth and drive teeth, the number of teeth of the ratchet teeth is twice as much as the number of teeth of the drive teeth and the operating lever is provided engageably to the ratchet teeth, further comprising a stop lever rotating by rotating the drive teeth, a coupling lever constituted to rotate by rotating the stop lever, an hour coupling operation lever rotating by rotating the stop lever, and an hour coupling lever rotating by rotating the hour coupling operation lever.

Further, according to another aspect of the invention, it is preferable to provide the lever apparatus for a time piece comprising a hammer transmission lever provided rotatably to a main plate of the time piece, a hammer setting lever constituted to rotate by rotating the hammer transmission lever, a hammer constituted to rotate by rotating the hammer transmission lever, the hour hammer lever constituted to rotate by rotating the hour hammer transmission lever, and the hour coupling lever constituted to rotate by rotating the hour hammer transmission lever, wherein the coupling transmission lever is constituted to rotate by rotating the hour coupling lever, the coupling transmission lever is constituted to rotate by rotating the hour coupling lever, and operation of the hammer setting lever and operation of the stop lever are controlled by rotating the drive teeth of the operating cam.

By the foregoing construction, there can be realized a lever apparatus for a time piece capable of operating the plurality of levers with certainty by using operating cams.

DETAILED DESCRIPTION OF THE PREFERRED EMBODIMENTS

Figure 1:
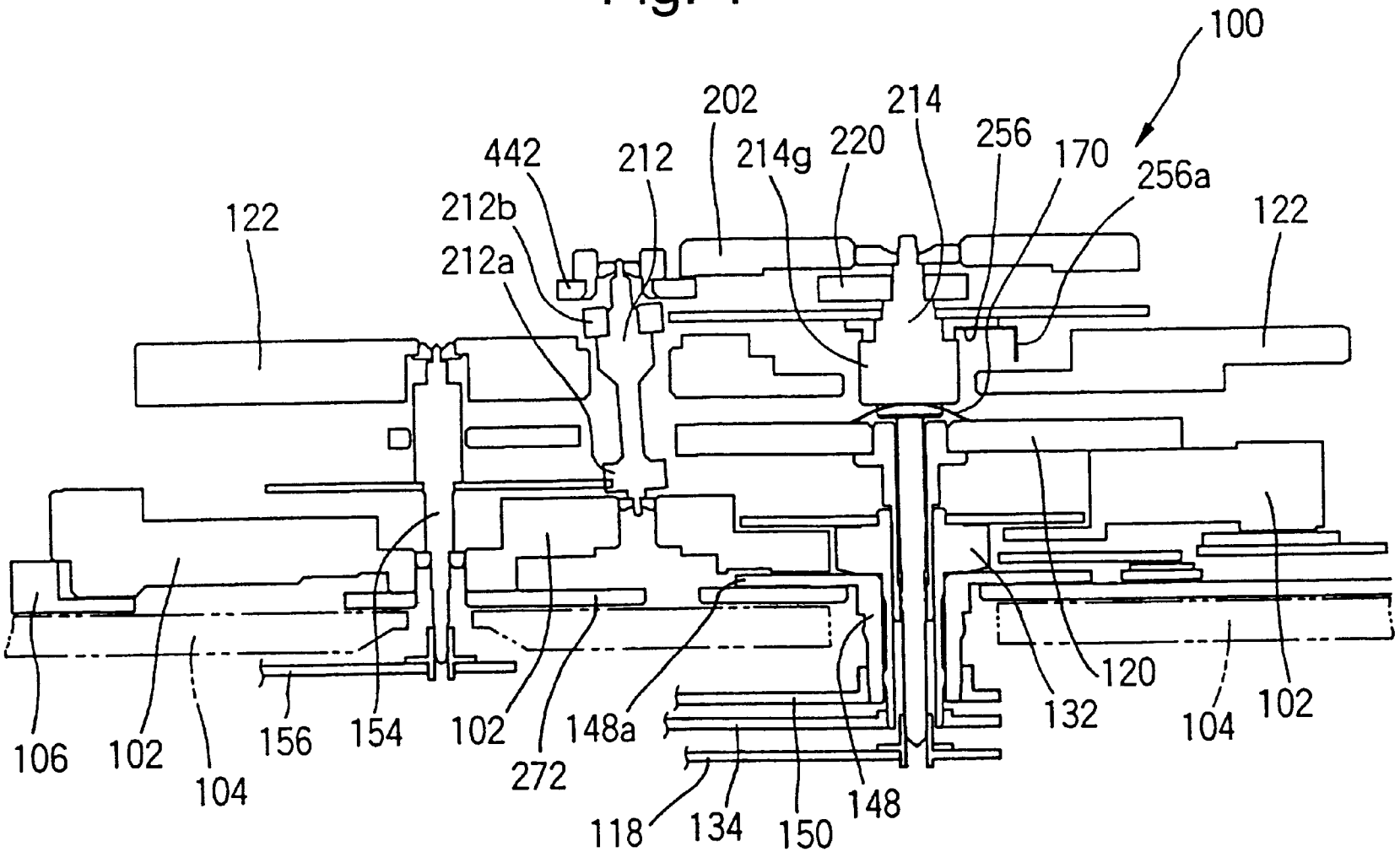
FIG. 1 is an outline partial sectional view showing a coupling portion of a chronograph mechanism (second counting wheel—second counter intermediate wheel—second wheel) in a state in which the chronograph mechanism is not operated according to an embodiment of a chronograph time piece of the invention.

Best Mode for Carrying Out the Invention

An explanation will be given of embodiments according to the invention in reference to the drawings as follows.

Further, in order to make clear the explanation, in the respective drawings, there is omitted a description of a structure of a portion which is inconsiderably related to the constitution of the invention. Therefore, there is omitted an explanation with regard to a switch apparatus, a hand setting apparatus, an automatic winding apparatus, a hand winding apparatus, a calendar apparatus, a calendar correcting apparatus and so on which can utilize structures similar to those in a conventional chronograph time piece.

(1) Constitutions of a front train wheel and a counting train wheel (1-1) State in which a chronograph mechanism is not operated.

In reference to FIG. 1 through FIG. 5, a movement (machine body) 100 of a chronograph time piece according to the invention is provided with a main plate 102, a center wheel & pinion bridge 120 and a third wheel & pinion bridge 122.

In both sides of the main plate 102, a side having a dial 104 is referred to as "back side" of the movement and a side opposed to the side having the dial 104 is referred to as "front side" of the movement. A train wheel integrated to the "front side" of the movement is referred to as "front train wheel" and a wheel train integrated to the "back side" of the movement is referred to as "back wheel train".

A dial bridge ring 106 is arranged between the main plate 102 and the dial 104. The dial bridge ring 106 receives a back face of the dial 104.

An outer peripheral portion of a front face of the dial 104 is normally provided with numerals from 1 to 12 or abbreviated characters corresponding thereto. Therefore, respective directions along the outer peripheral portion of the time piece can be expressed by using the numerals.

For example, in the case of a wrist watch, upper direction and upper side of the wrist watch are respectively referred to as "12 o'clock direction" and "12 o'clock side", right direction and right side of the wrist watch are respectively referred to as "3 o'clock direction" and "3 o'clock side", lower direction and lower side of the wrist watch are respectively referred to as "16 o'clock direction" and "6 o'clock side", and left direction and left side of the wrist watch are respectively referred to as "9 o'clock direction" and "9 o'clock side".

Similarly, direction and position in correspondence with 2 o'clock indicator of the dial are referred to as "2 o'clock direction" and "2 o'clock position", direction and position in correspondence with 4 o'clock indicator of the dial are referred to as "4 o'clock direction" and "4 o'clock position".

Figure 5:
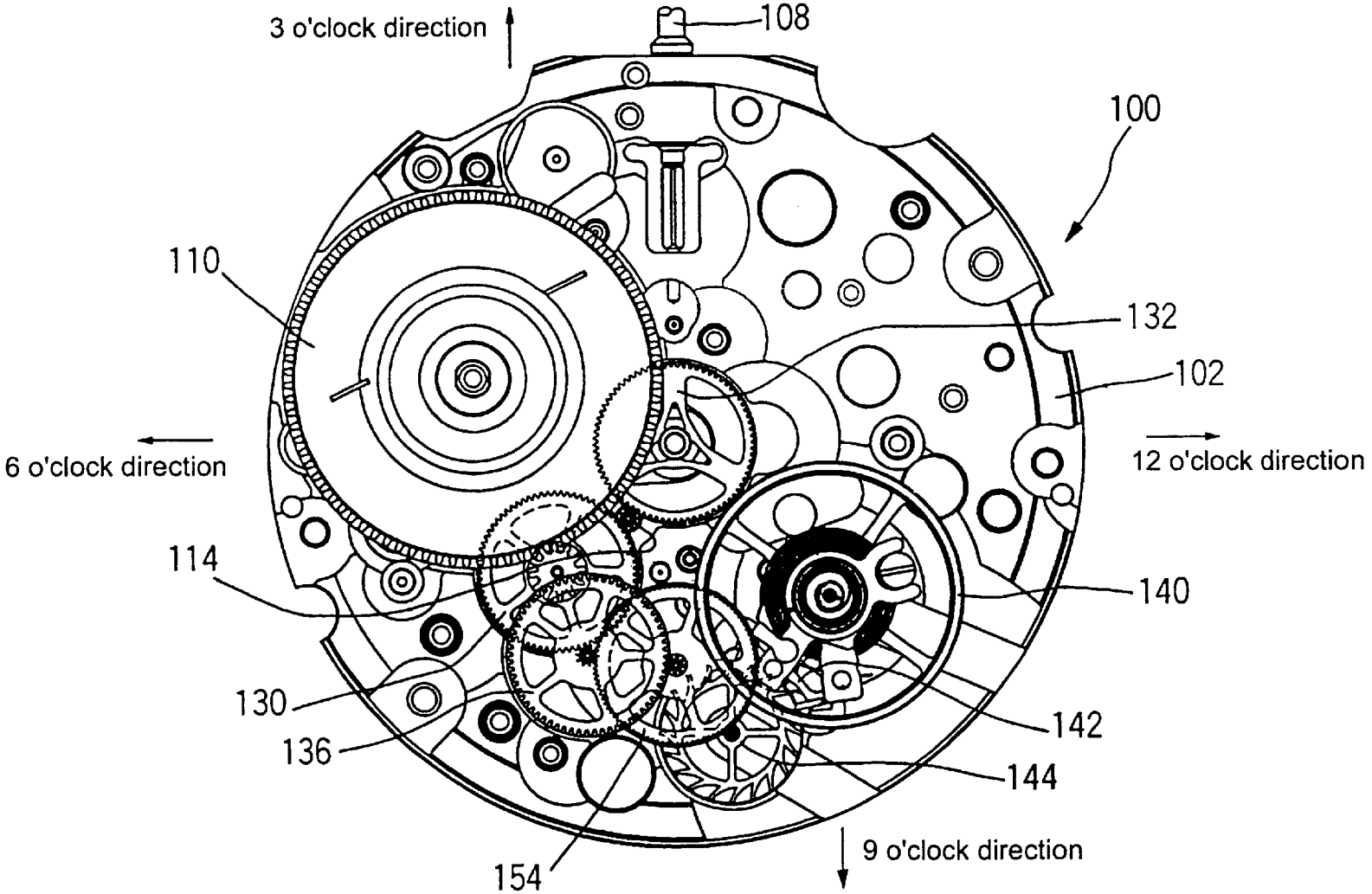
FIG. 5 is an outline partial plane view showing the front wheel train, the escapement apparatus and the speed control apparatus according to the embodiment of the chronograph time piece of the invention.
Figure 6:
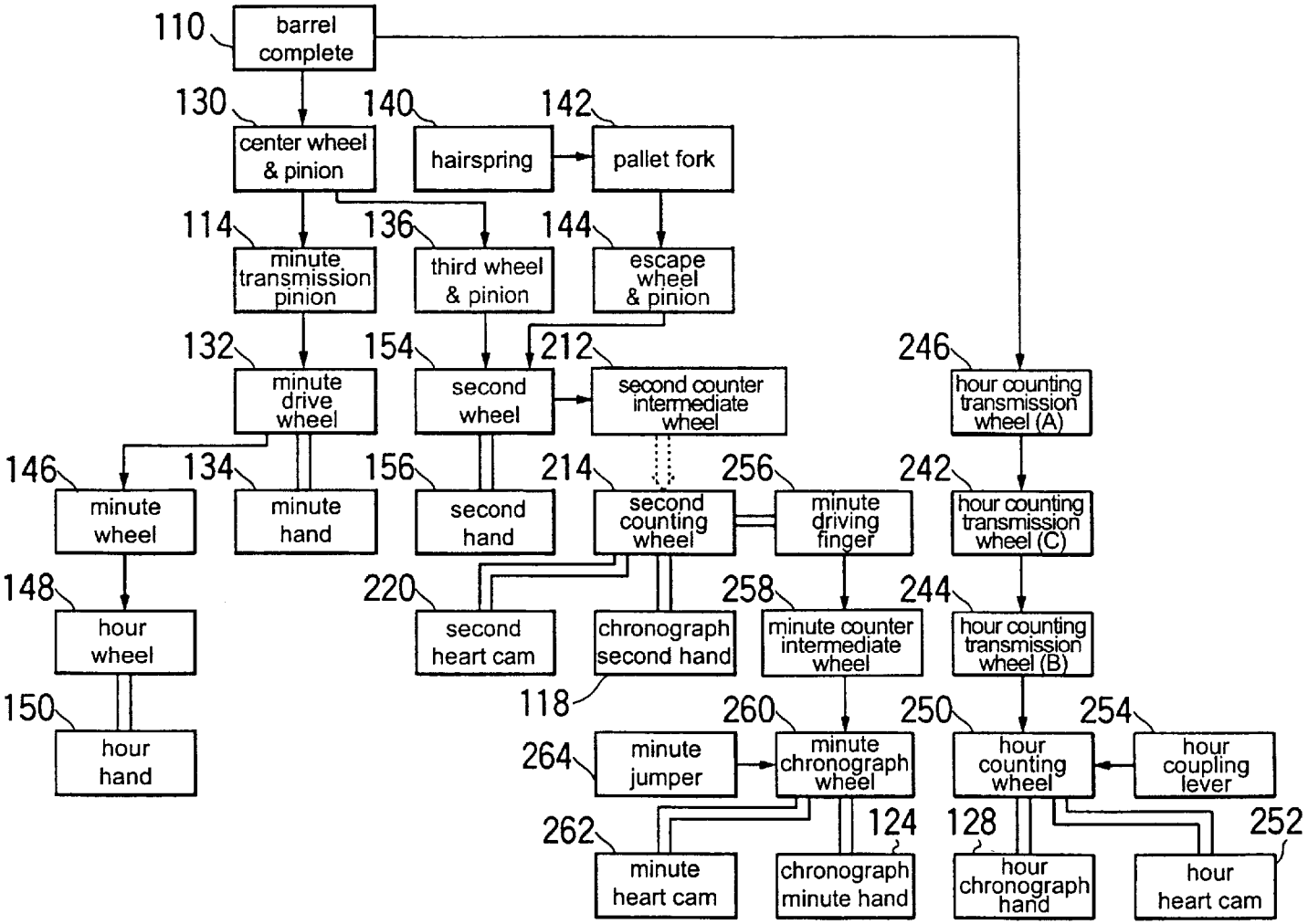
FIG. 6 is a functional block diagram showing a train wheel constitution according to an embodiment of a chronograph time piece of the invention.

For example, in FIG. 5, there are shown "12 o'clock direction", "3 o'clock direction", "6 o'clock direction" and "9 o'clock direction". In this case, a winding stem 108 is arranged in "13 o'clock direction" of the movement.

In reference to FIG. 3 through FIG. 6, a barrel complete 110 is rotatably integrated to the third wheel & pinion bridge 122 and the main plate 102. A mainspring (not illustrated) provided in the barrel complete 110 constitutes a power source of the chronograph time piece. A center wheel & pinion 130 is provided to rotate based on rotation of the barrel complete 110. A minute transmission pinion 114 is provided to rotate based on rotation of the center wheel & pinion 130. A minute drive wheel 132 is provided to rotate based on rotation of the minute transmission pinion 114. According to the structure, the minute transmission pinion 114 constitutes an idler. A minute hand 134 attached to the minute drive wheel 132 is constituted to display "minute".

Figure 3:
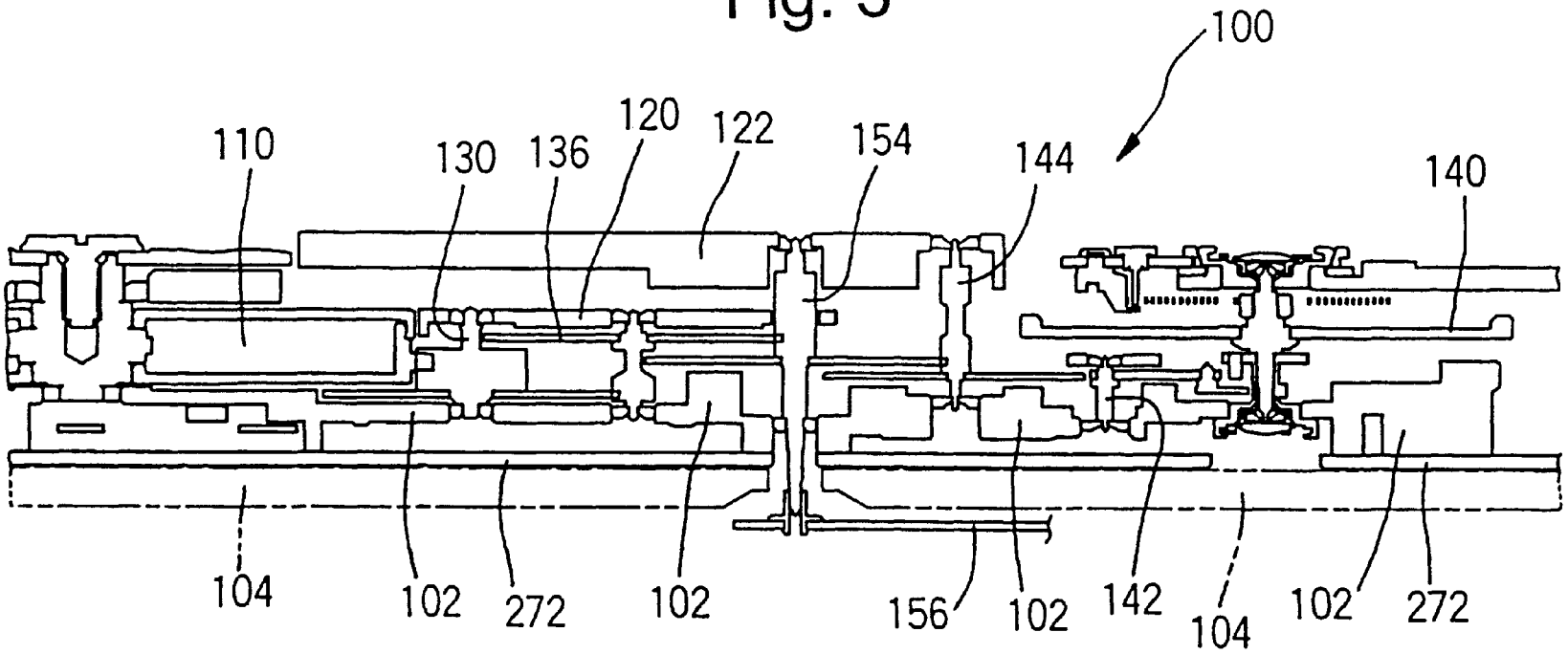
FIG. 3 is an outline partial sectional view showing a front wheel train, an escapement apparatus and a speed control apparatus according to an embodiment of a chronograph time piece of the invention.

In reference to FIG. 3, a third wheel & pinion 136 is provided to rotate based on rotation of the center wheel & pinion 130. The third wheel & pinion 136 is rotatably supported by the third wheel & pinion bridge 122 and the main plate 102. A second wheel 154 is provided to rotate based on rotation of the third wheel & pinion 136. The second wheel 154 is rotatably supported by the third wheel & pinion bridge 122 and the main plate 102. The second wheel 154 is provided to rotate by one rotation per minute. A second hand 156 attached to the second wheel 154 is constituted to display "second". A rotational center of the second wheel 154 is different from a rotational center of the minute wheel 132. That is, the second hand 156 constitutes a so-to-speak "small second hand".

A balance with hairspring 140 constitutes a speed control apparatus of the time piece and a pallet fork 142 and an escape wheel & pinion 144 constitute an escapement apparatus of the time piece. Rotation of the second wheel 154 is controlled by the balance with hairspring 140, the pallet fork 142 and the escape wheel & pinion 144. The minute drive wheel 132 is provided to rotate by one rotation per hour.

Figure 4:
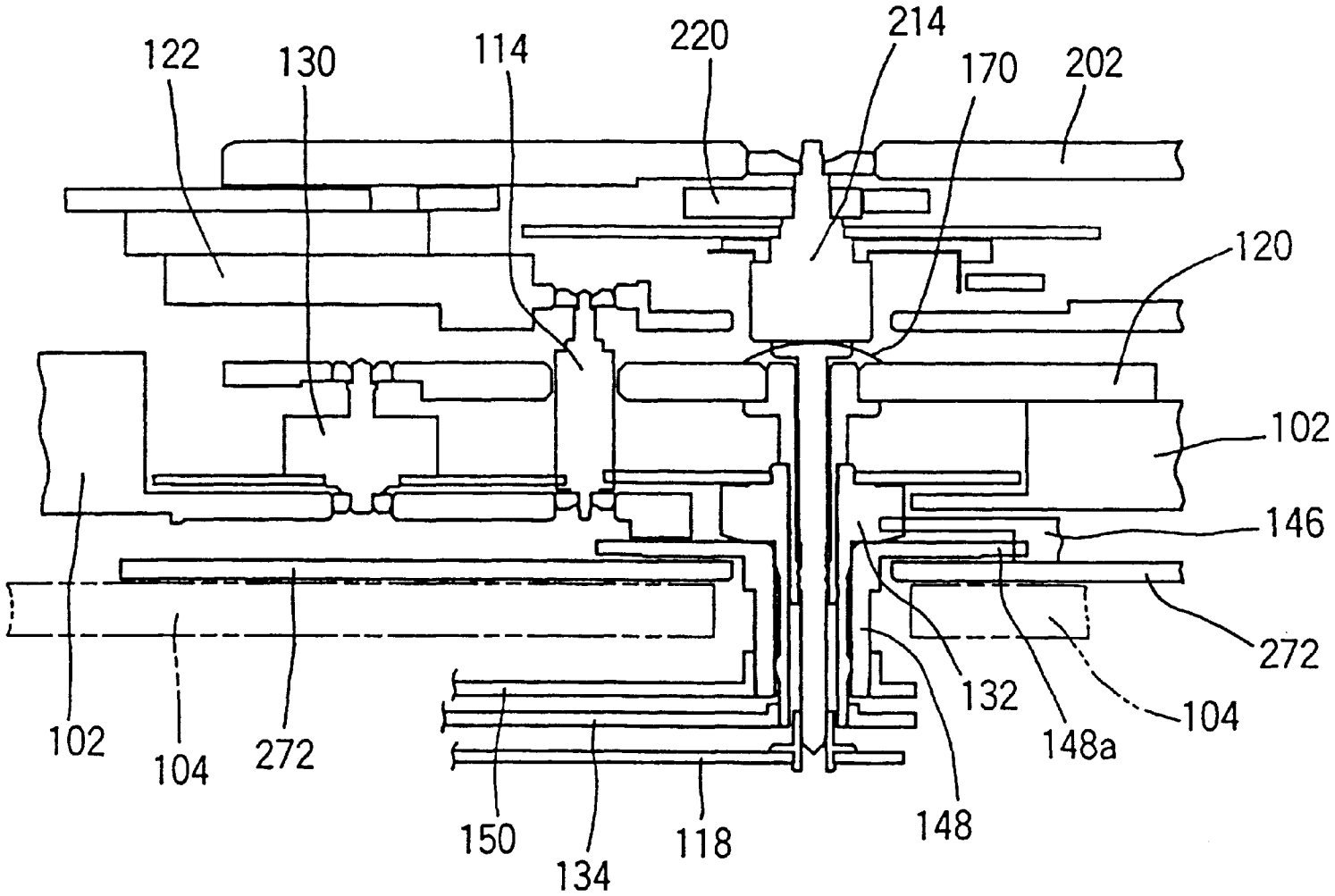
FIG. 4 is an outline partial sectional view showing a portion of a minute transmission pinion according to an embodiment of a chronograph time piece of the invention.

In reference to FIG. 4, a minute wheel 146 is provided to rotate based on rotation of the minute drive wheel 132. An hour wheel 148 is provided to rotate by one rotation per 12 hours based on rotation of the minute wheel 146. A gear portion 148*a* of the hour wheel 148 is arranged between the main plate 102 and a date indicator holder 272. An hour hand 150 attached to the hour wheel 148 is constituted to display "hour". According to the constitution of the invention, the rotational center of the minute drive wheel 132 is the same as a rotational center of the hour wheel 148.

In reference to FIG. 5, a rotational center of the barrel complete 110 is disposed between "3 o'clock direction" and "6 o'clock direction" of the movement. A rotational center of the balance with hairspring 140 is disposed between "9 o'clock direction" and "12 o'clock direction" of the movement. The rotational center of the second wheel 154 is disposed substantially in "9 o'clock direction" of the movement. A rotational center of the center wheel & pinion 130, a rotational center of the minute drive wheel 132 and a rotational center of the third wheel & pinion 136 are disposed between "6 o'clock direction" and "9 o'clock direction" of the movement.

In reference to FIG. 1, in a state in which a chronograph mechanism is not operated, a second counter intermediate wheel 212 is rotatably integrated to a coupling lever 442 and the main plate 102. The second counter intermediate wheel 212 is provided with a second counter intermediate pinion 212*a* and a second counting transmission pinion 212*b*. The intermediate second counter intermediate pinion 212*a* is in mesh with the second wheel 154. The second counter intermediate wheel 212 is provided to rotate based on rotation of the second wheel 154.

A second counting wheel 214 is rotatably integrated to a chronograph bridge 202 and the center wheel & pinion bridge 120. A rotational center of the second counting wheel 214 is the same as the rotational center of the minute drive wheel 132 and the hour wheel 148. A dial washer 170 is integrated between a large diameter portion "g" of the second counting wheel 214 and the center wheel & pinion bridge 120 to push the second counting wheel 214 to the chronograph bridge 202. By using the dial washer 170, operation of a chronograph second hand 118 can be stabilized in rotating the second chronograph wheel 214.

Figure 7:
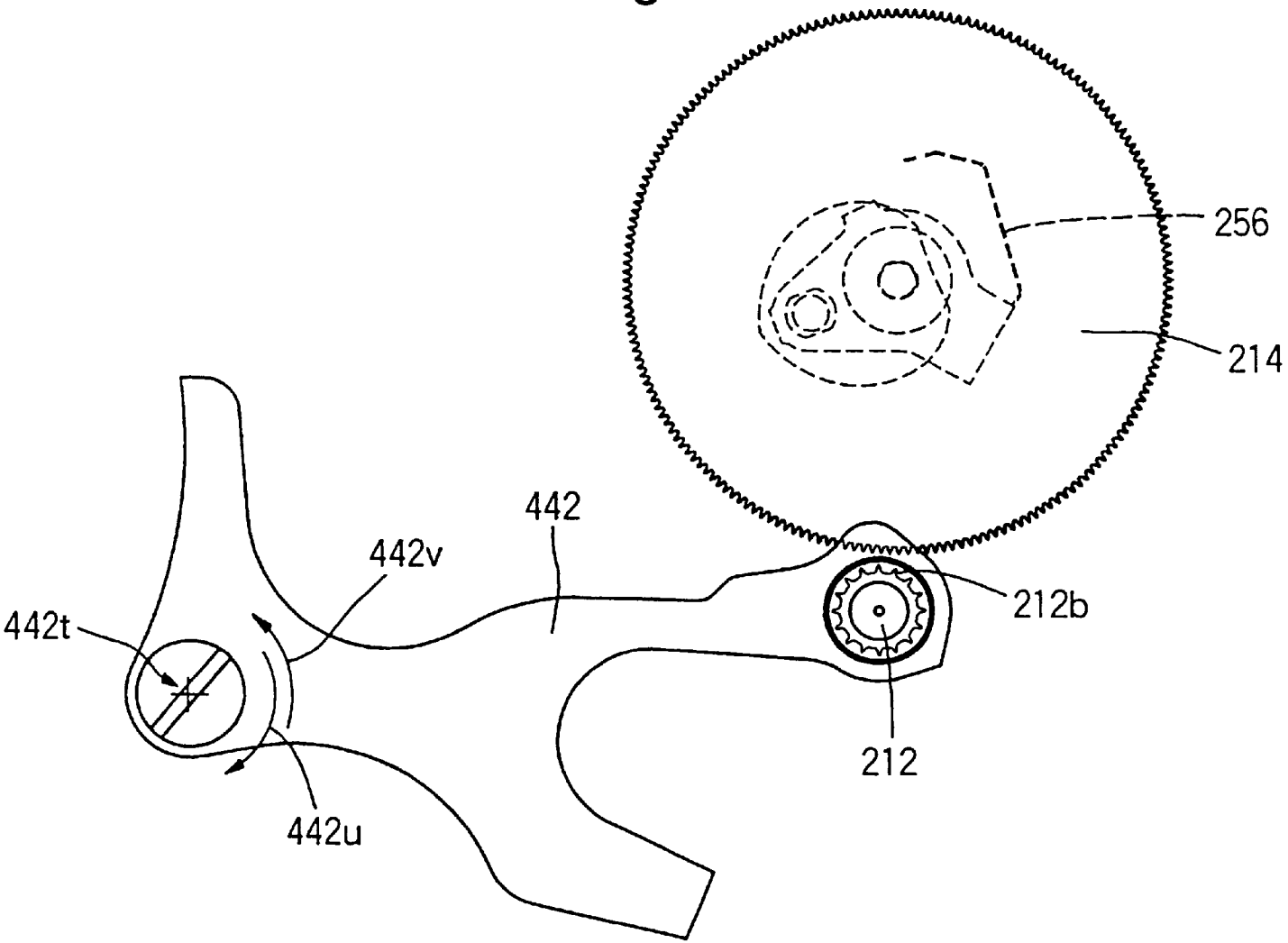
FIG. 7 is an outline partial plane view showing a portion of a coupling portion of a chronograph mechanism (second counting wheel—second counter intermediate wheel) in a state in which the chronograph mechanism is not operated according to an embodiment of the chronograph time piece of the invention.

In reference to FIG. 1 and FIG. 7, in the state in which the chronograph mechanism is not operated, the coupling lever 442 is moved to rotate in a direction of an arrow mark 442*u* centering on a rotational center 442*t* such that the chronograph mechanism is not operated. As a result, the second chronograph transmission pinion 212*b* is constituted not to be in mesh with the second counting wheel 214.

In contrast thereto, in the state of operating the chronograph mechanism, as mentioned later, the coupling lever 442 is moved to rotate in a direction of an arrow mark 442*v* centering on a rotational center 442*t* such that the chronograph mechanism is operated. As a result, the second counting transmission pinion 212*b* is constituted to be in mesh with the second counting wheel 214. In such a state in which the second chronograph transmission pinion 212*b* and the second counting wheel 214 are in mesh with each other, the second counting wheel 214 is constituted to rotate by one rotation per minute.

The chronograph second hand 118 is attached to the second counting wheel 214 and is constituted to display a result of measurement of an elapse time period of second. The chronograph second hand 118 is a chronograph second display member and may be a time piece hand or may be a mode of a circular disk, hand or foot of a character, flower, star or the like.

When the chronograph time piece according to the invention is constituted by an automatic winding time piece, an oscillating weight (not illustrated) is rotatably integrated to the chronograph bridge 202. The automatic winding time piece may be constituted to wind a mainspring (not illustrated) via an automatic winding mechanism (not illustrated) by rotating the oscillating weight.

A second heart cam 220 is fixed to the second counting wheel 214 and is constituted to rotate integrally with the second counting wheel 214.

As shown by FIG. 1, in the state in which the chronograph mechanism is not operated, the coupling lever 442 positions the second counting transmission pinion 212*b* such that the second counting transmission pinion 212*b* is separated from the second counting wheel 214.

Figure 2:
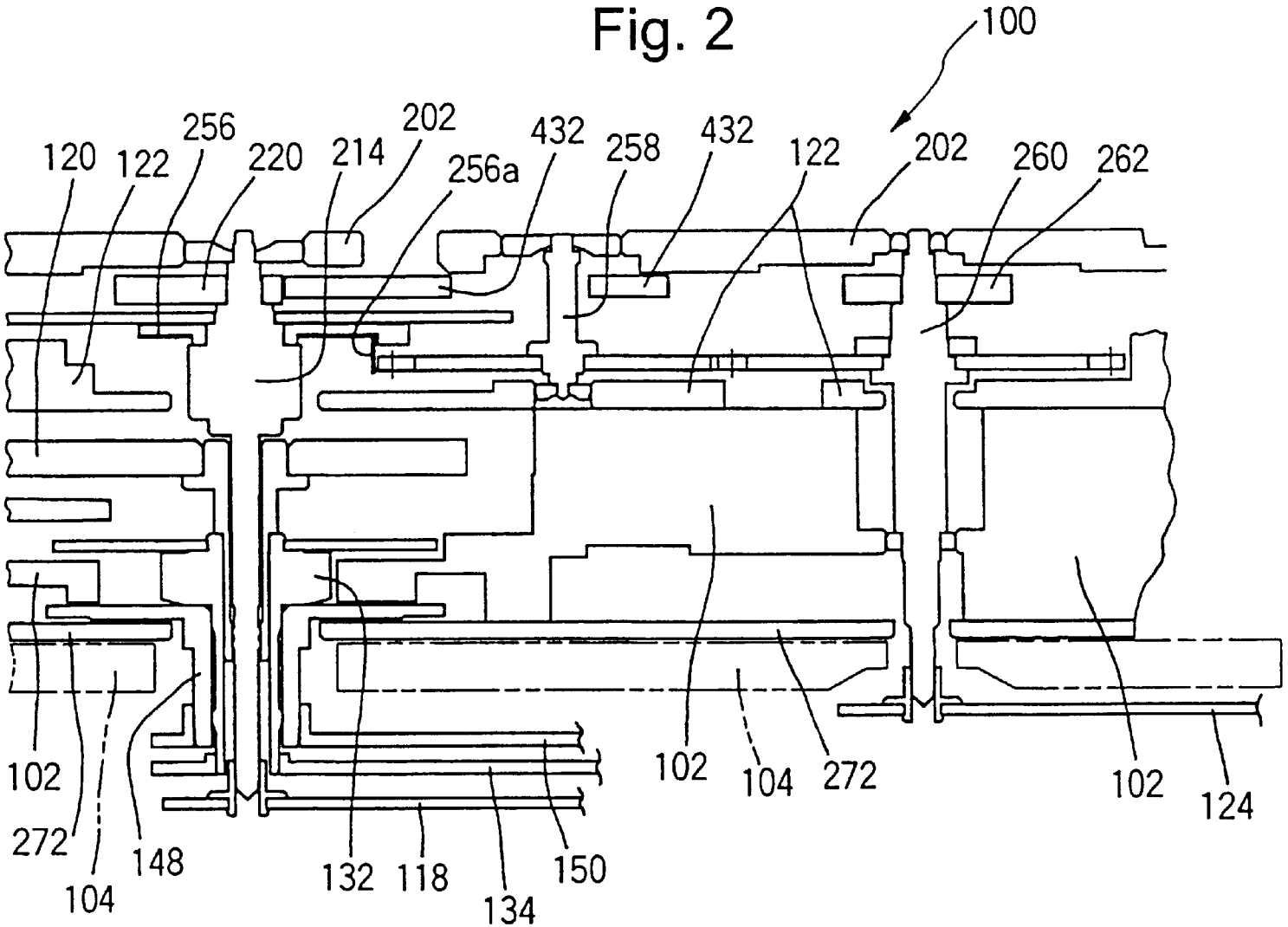
FIG. 2 is an outline partial sectional view showing a minute counting train wheel (minute counter intermediate wheel —minute counting wheel) according to an embodiment of a chronograph time piece of the invention.

In reference to FIG. 2, a minute counter intermediate wheel 258 is rotatably integrated to the chronograph bridge 202 and the third wheel & pinion bridge 122. A minute driving finger 256 is fixed to the second counting wheel 214.

Figure 8:
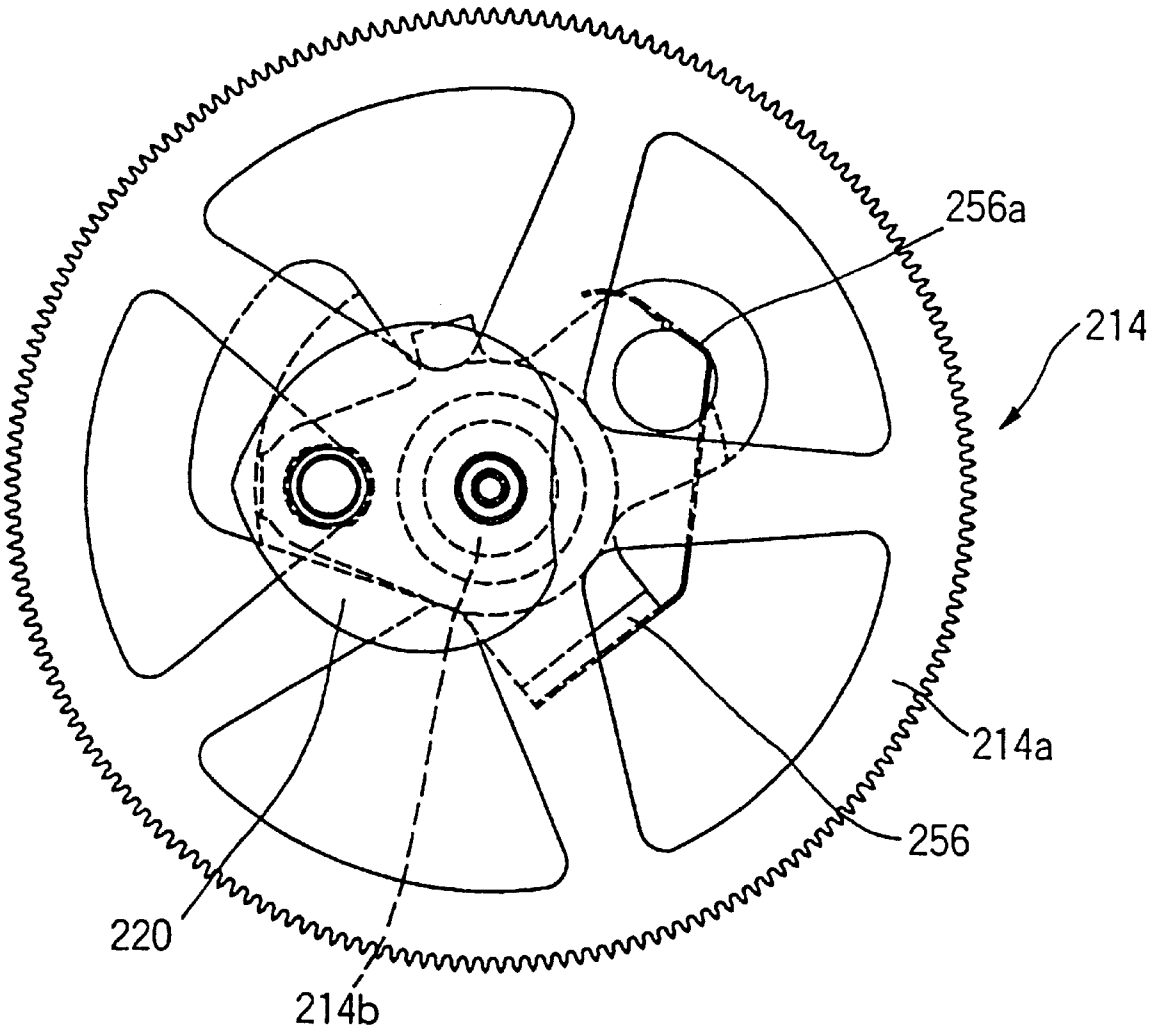
FIG. 8 is an enlarged plane view of a second counting wheel according to an embodiment of a chronograph time piece of the invention.
Figure 9:
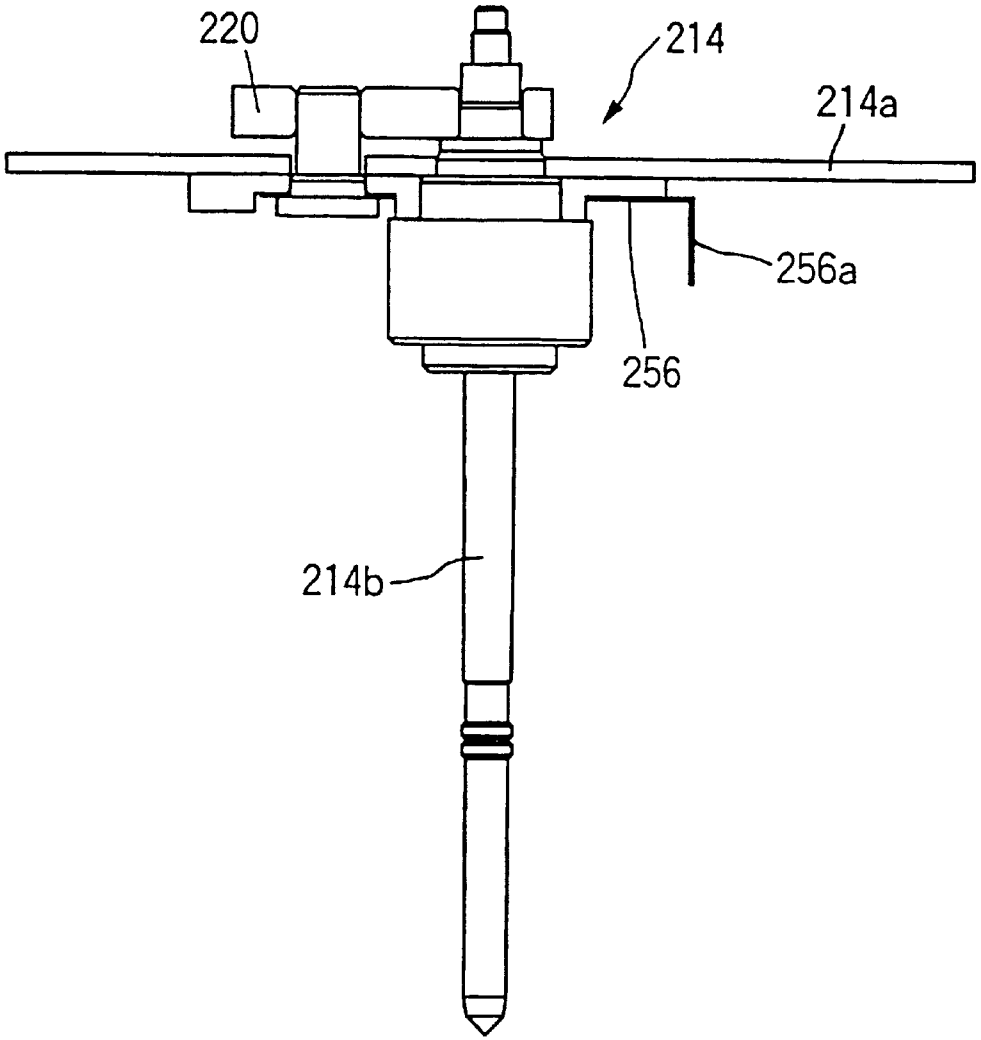
FIG. 9 is an enlarged front view of the second counting wheel according to the embodiment of the chronograph time piece of the invention.

In reference to FIG. 8 and FIG. 9, the second counting wheel 214 is constituted to be provided with a second counting gear 214*a,* a second counting stem 214*b,* the second heart cam 220 and the second driving finger 256. The second driving finger 256 is constituted by an elastic material to provide spring performance. A minute driving finger 256*a* is provided to the minute driving finger 256 and is brought into contact with a gear portion of the second counter intermediate wheel 258.

When the second counting wheel 214 is rotated by one rotation, the minute driving finger 256 feeds the gear portion of the minute counter intermediate wheel 258 to thereby rotate the minute counter intermediate wheel 258 by an amount of one tooth.

A minute counting wheel 260 is rotatably integrated to the chronograph bridge 202 and the main plate 102. The minute counting wheel 260 is constituted to rotate based on rotation of the minute counter intermediate wheel 258. A minute jumper 264 sets rotation of the minute counting wheel 260 by elastic force. A minute heart cam 262 is fixed to the minute counting wheel 260.

A minute chronograph hand 124 is attached to the minute counting wheel 260 and is constituted to display a result of measurement of an elapse time period of, for example, "minute" such as "1 minute".

The minute chronograph hand 124 is a minute chronograph display member and may be a time piece hand or may be a mode of a circular disk, hand or foot of a character, flower, star or the like.

Figure 10:
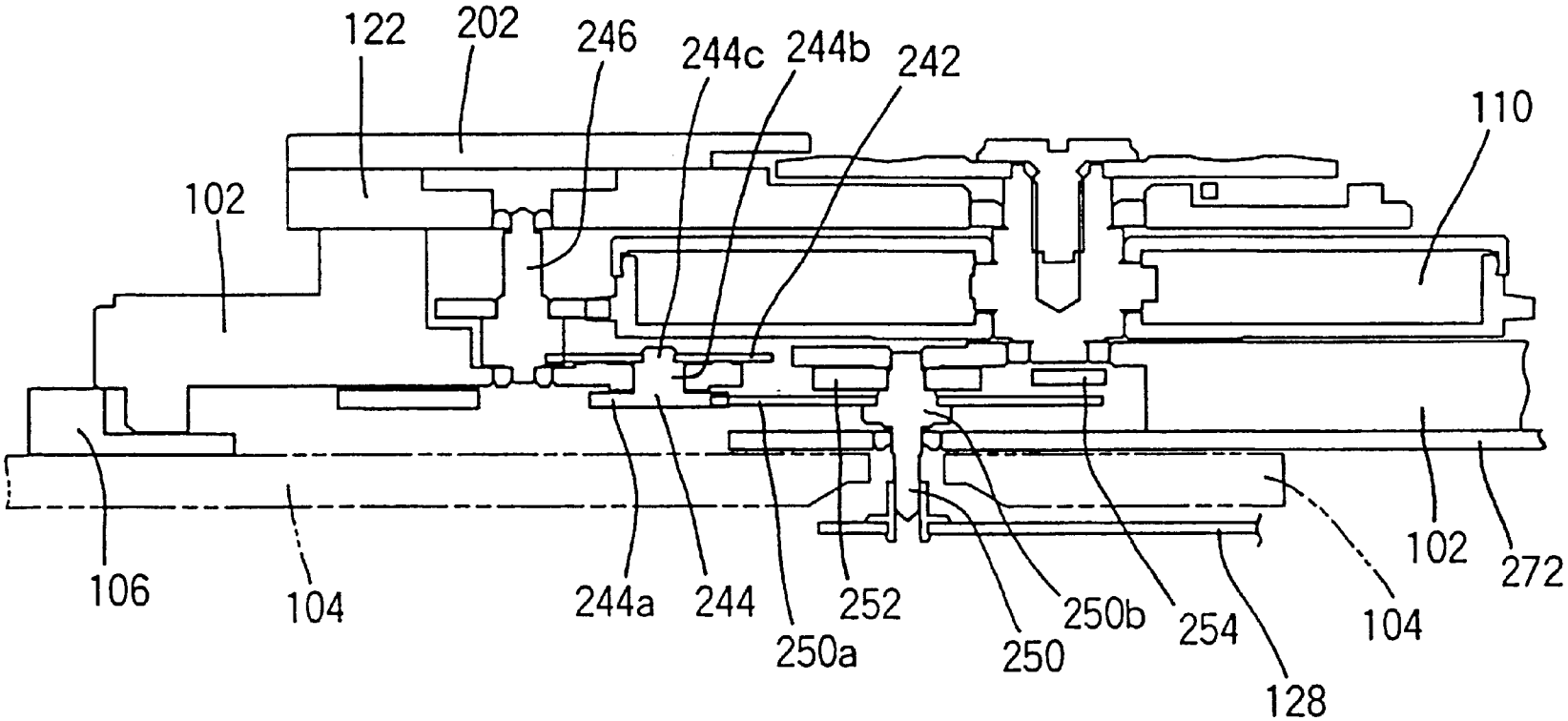
FIG. 10 is an outline partial sectional view showing an hour counting train wheel (hour counting transmission wheel —hour counting wheel) according to an embodiment of the chronograph time piece of the invention.
Figure 11:
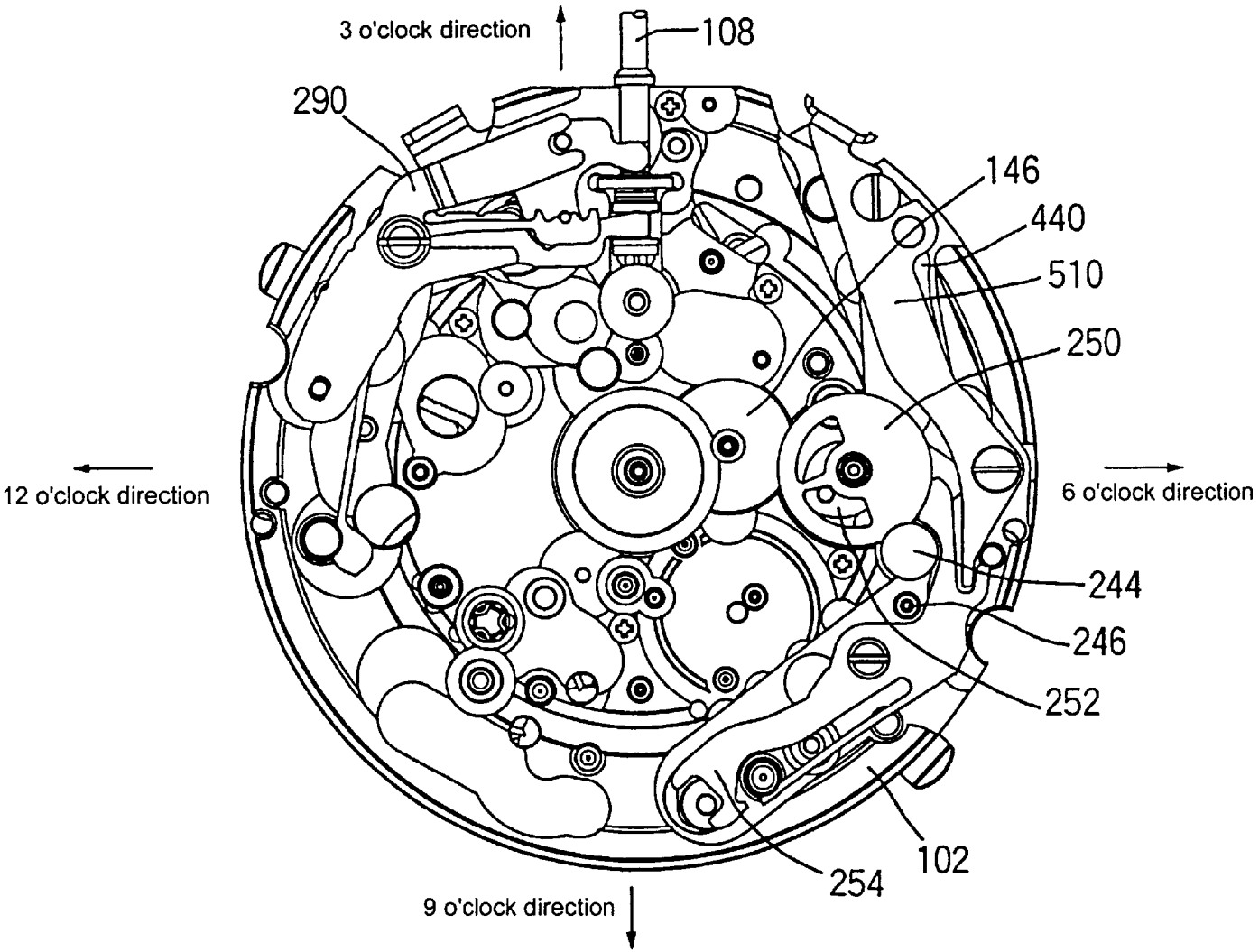
FIG. 11 is an outline partial plane view showing the hour counting train wheel (hour counting transmission wheel —hour counting wheel) according to the embodiment of the chronograph time piece of the invention.

In reference to FIG. 10 and FIG. 11, an hour counting transmission wheel (A) 246 is rotatably integrated to the main plate 102 and the third wheel & pinion bridge 122 and is constituted to rotate based on rotation of the barrel complete 110. An upper guide shaft portion of the hour counter intermediate wheel (A) 246 may be constituted to be guided by the third wheel & pinion bridge 122 or guided by the chronograph bridge 202.

An hour counting transmission wheel (B) 244 is provided with a gear portion 244*a,* a guide shaft portion 244*b* and a fitting portion 244*c*. According to the hour counting transmission wheel (B) 244, the gear portion 244*a* is arranged on the dial side of the main plate 102 and the guide shaft portion 246*b* is rotatably integrated to the main plate 102. An hour counting transmission wheel (C) 242 is integrated to the fitting portion 245*c* of the hour counting transmission wheel (B) 244.

Figure 12:
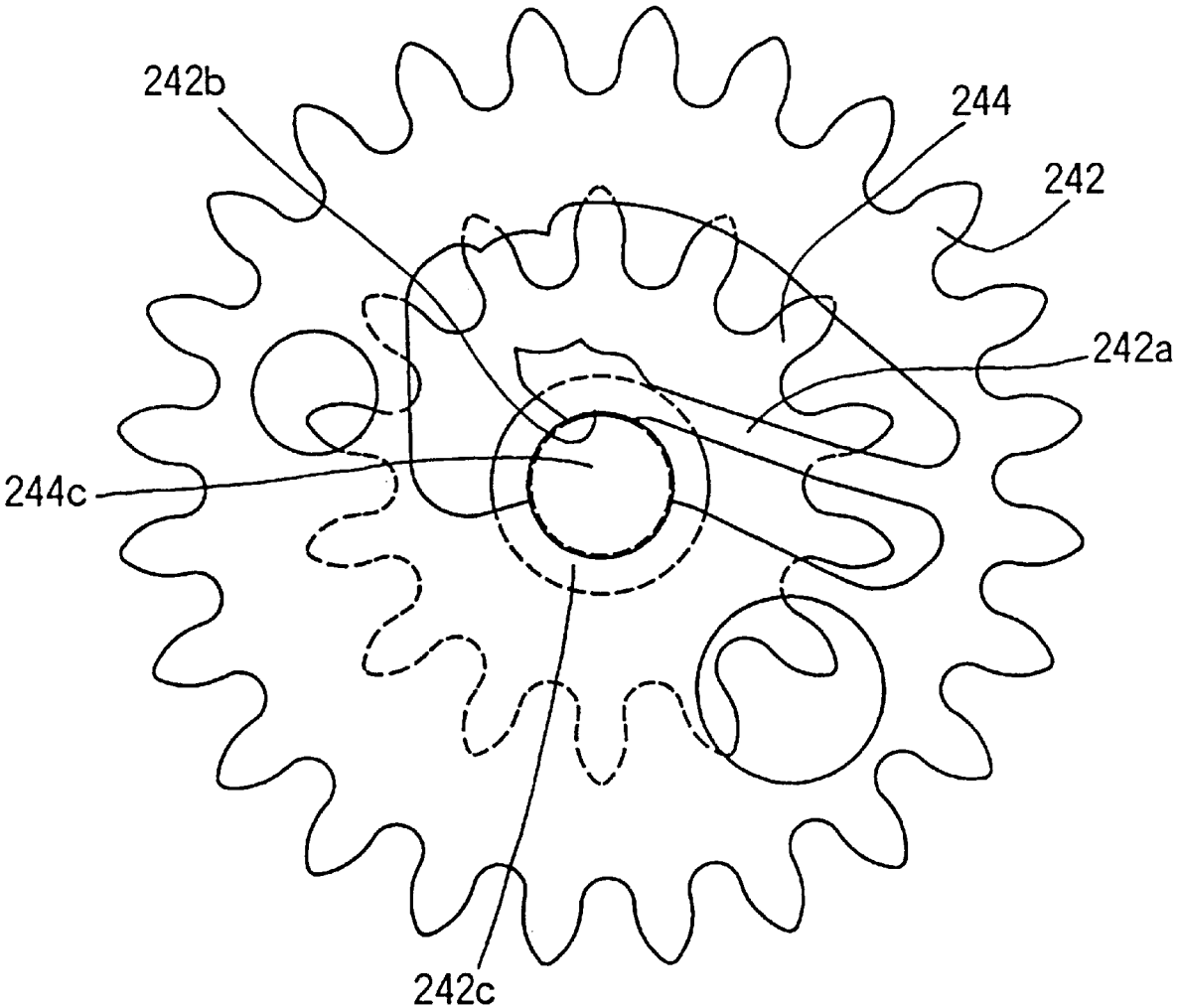
FIG. 12 is an enlarged plane view showing an hour counting transmission wheel (C) according to the embodiment of the chronograph time piece of the invention.

In reference to FIG. 12, the hour counting transmission wheel (C) 242 is provided with an elastically deformable spring portion 242*a,* a contact portion 242*b* and a guide portion 242*c*. The contact portion 242*b* is provided at a front end side portion of the spring portion 242*a*. The contact portion 242*b* and the guide portion 242*c* are integrated to the fitting portion 244*c* of the hour counting transmission wheel (B) 244. Therefore, the hour counting transmission wheel (C) 242 can slip relative to the hour counting transmission wheel (B) 244 when predetermined slip torque is exceeded. According to the embodiment of the invention, the slip torque is constituted to be, for example, about 0.2 g per cm.

According to the constitution, by rotating the barrel complete 110, the hour counting transmission wheel (A) 246 is rotated and by rotating the hour counting transmission wheel (A) 246, the hour counting transmission wheel (C) 242 and the hour counting transmission wheel (B) 244 are integrally rotated.

An hour counting wheel 250 is rotatably provided to the main plate 102 and the date indicator holder 272 and is constituted to rotate based on rotation of the hour counting transmission wheel (B). The hour counting wheel 250 is provided with an hour counting gear 250*a,* an hour counting stem 250*b* and the hour chronograph stem 250*b* and an hour heart cam 252 and an hour heart cam 252 are constituted to be able to rotate integrally.

In FIG. 11, there are shown "12 o'clock direction", "3 o'clock direction", "6 o'clock direction" and "9 o'clock direction" of the movement.

A rotational center of the hour counting wheel 250 is disposed substantially in "6 o'clock direction" of the movement. A switch apparatus 290 is disposed between "3 o'clock direction" and "12 o'clock direction" of the movement. The switch apparatus 290 includes a setting lever, a yoke and a setting lever holder and the like.

An hour chronograph hand 128 is attached to the hour counting stem 250*b* and is constituted to display a result of measurement of an elapse time period of, for example, "hour" such as "1 hour" when the chronograph mechanism is operated.

The hour chronograph hand 128 is an hour chronograph display member and may be a time piece hand or may be a mode of a circular disk, hand or foot of a character, flower, star or the like.

When the chronograph time piece according to the invention is constituted as a time piece with calendar, a date indicator (not illustrated) is rotatably integrated to the main plate 102. According to such a constitution, display of "date" can be carried out by date characters printed on the date indicator. The date indicator is operated by a calendar feed mechanism (not illustrated) based on rotation of the front train wheel (divided from barrel complete).

Figure 13:
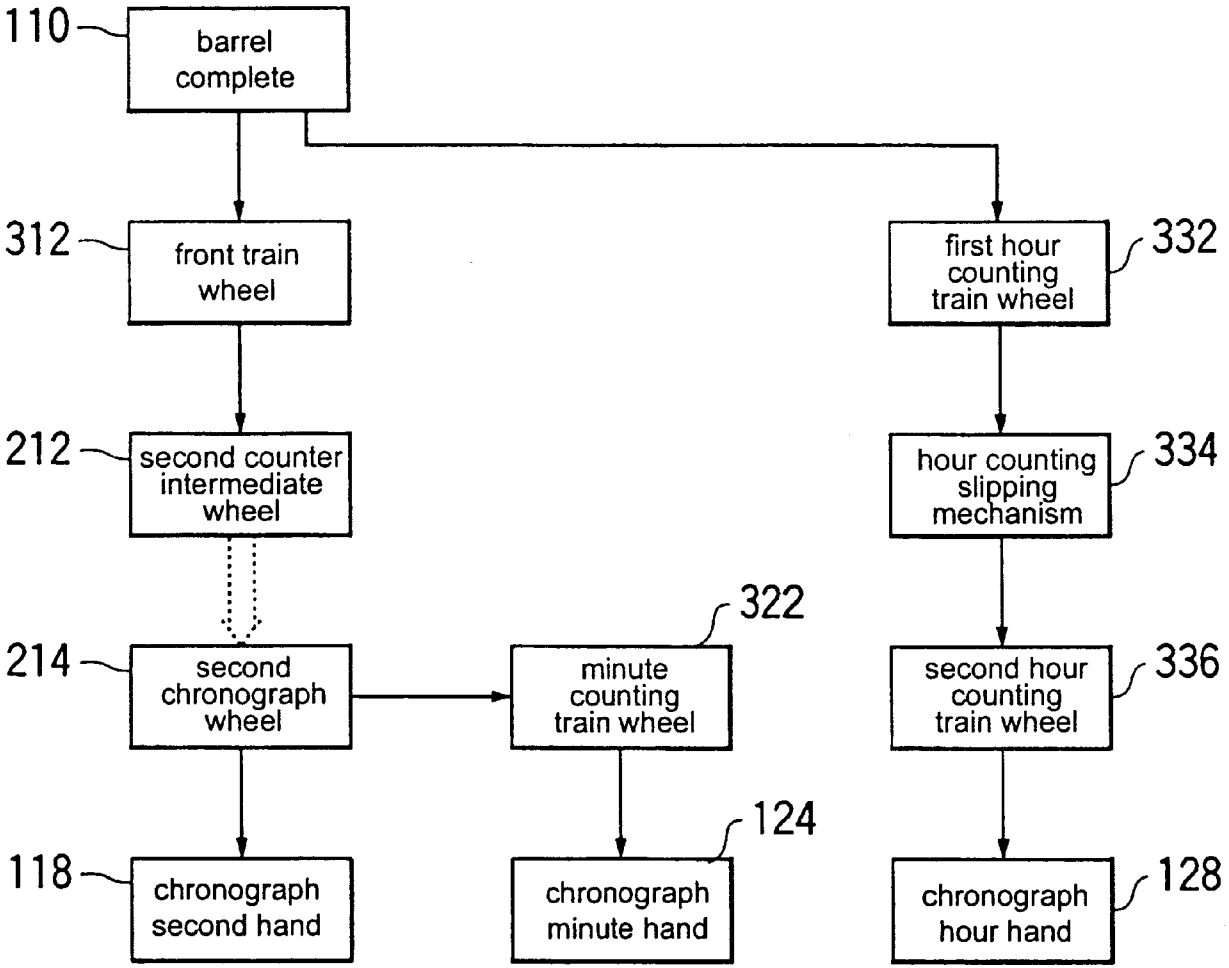
FIG. 13 is a functional block diagram showing a train wheel constitution according to an embodiment of a chronograph time piece of the invention.

In reference to FIG. 13, according to the chronograph time piece of the invention explained above, the front train wheel 312 is rotated by rotation of the barrel complete 110. The front train wheel 312 includes the center wheel & pinion 130, the minute transmission pinion 114, the minute drive wheel 132, the third wheel & pinion 136 and the second wheel 154. The second counter intermediate wheel 212 is rotated by rotation of the front train wheel 312. In the state in which the chronograph mechanism is not operated, the second counter intermediate wheel 212 is not in mesh with the second counting wheel 214.

In the state in which the chronograph mechanism is operated, the second counter intermediate wheel 212 is in mesh with the second counting wheel 214. Therefore, by the chronograph second hand 118 attached with the second counting wheel 214, there can be displayed a result of measurement of "second" of the chronograph.

A minute counting train wheel 322 is rotated by rotation of the second counting wheel 214. The minute counting train wheel 322 includes the minute counter intermediate wheel 258 and the minute counting wheel 260. Therefore, by the chronograph minute hand 124 attached to the minute counting wheel 260, there can be displayed a result of measurement of "minute" of the chronograph.

A first hour counting train wheel 332 is rotated by rotation of the barrel complete 110. The first hour counting train wheel 332 includes the hour counting transmission wheel (A) 246 and the hour counting transmission wheel (C) 242. An hour counting slipping mechanism 334 is provided between the first hour counting train wheel 332 and a second hour counting train wheel 336. The hour counting slip mechanism 334 is constituted by the contact portion 242*b* and the guide portion 242*c* of the hour counter intermediate transmission wheel (C) 242 and the fitting portion 244*c* of the hour counter intermediate transmission wheel (B).

The second hour counting train wheel 336 includes the hour counter intermediate transmission wheel (B) and the hour counting wheel 250. The second hour counting train wheel 336 is rotated by rotation of the first hour counting train wheel 332. Therefore, by the chronograph hour hand 128 attached to the hour counting wheel 250, there can be displayed a result of measurement of "hour" of the chronograph.

When the rotation of the second hour counting train wheel 336 is set, by slip action of the hour counting slip mechanism 334, the first hour counting train wheel 332 is rotated while slipping relative to the second hour counting train wheel 336.

(1-2) State in which the chronograph mechanism is operated

Figure 14:
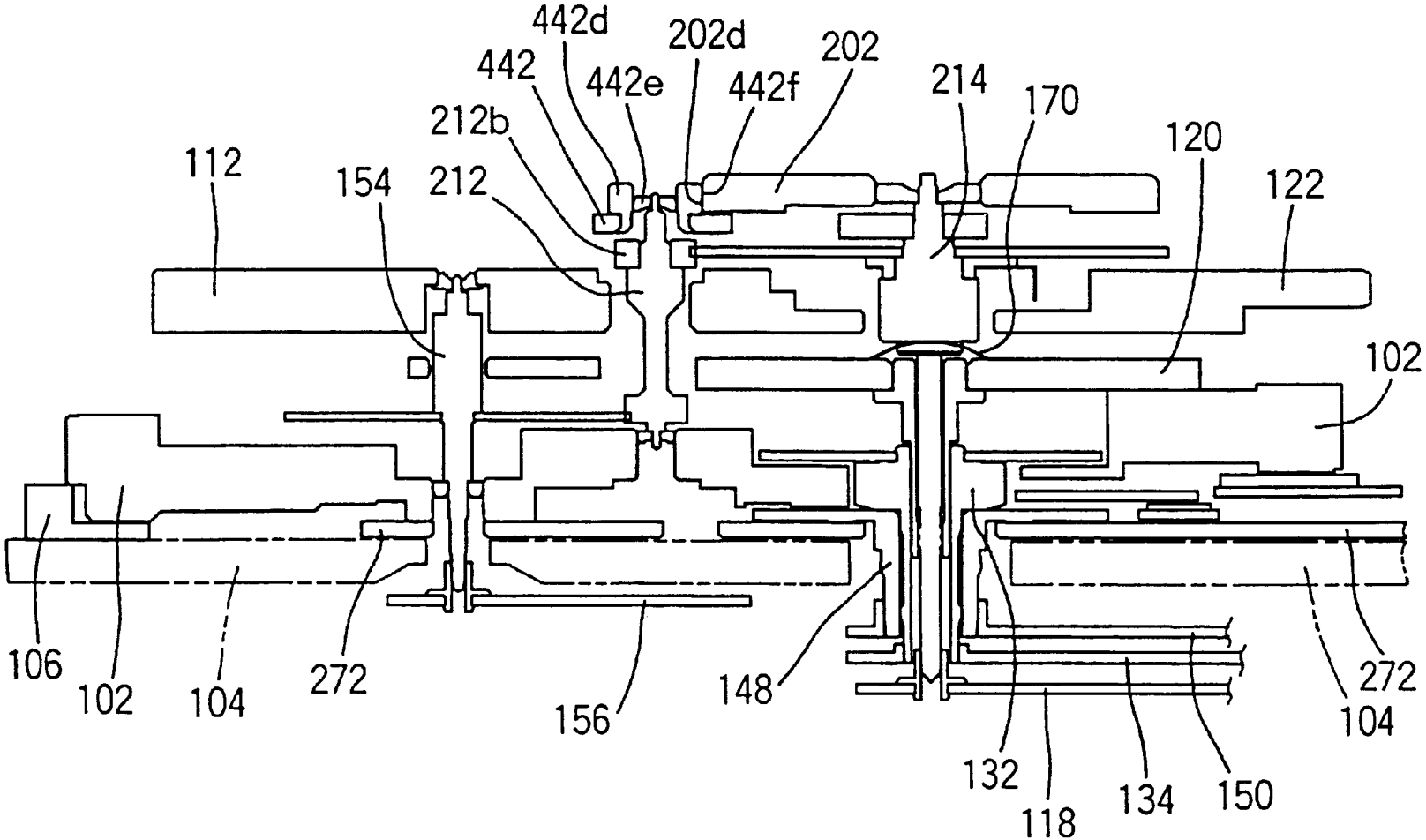
FIG. 14 is an outline partial sectional view showing a coupling portion of a chronograph mechanism in a state in which the chronograph mechanism is operated according to an embodiment of a chronograph time piece of the invention.
Figure 15:
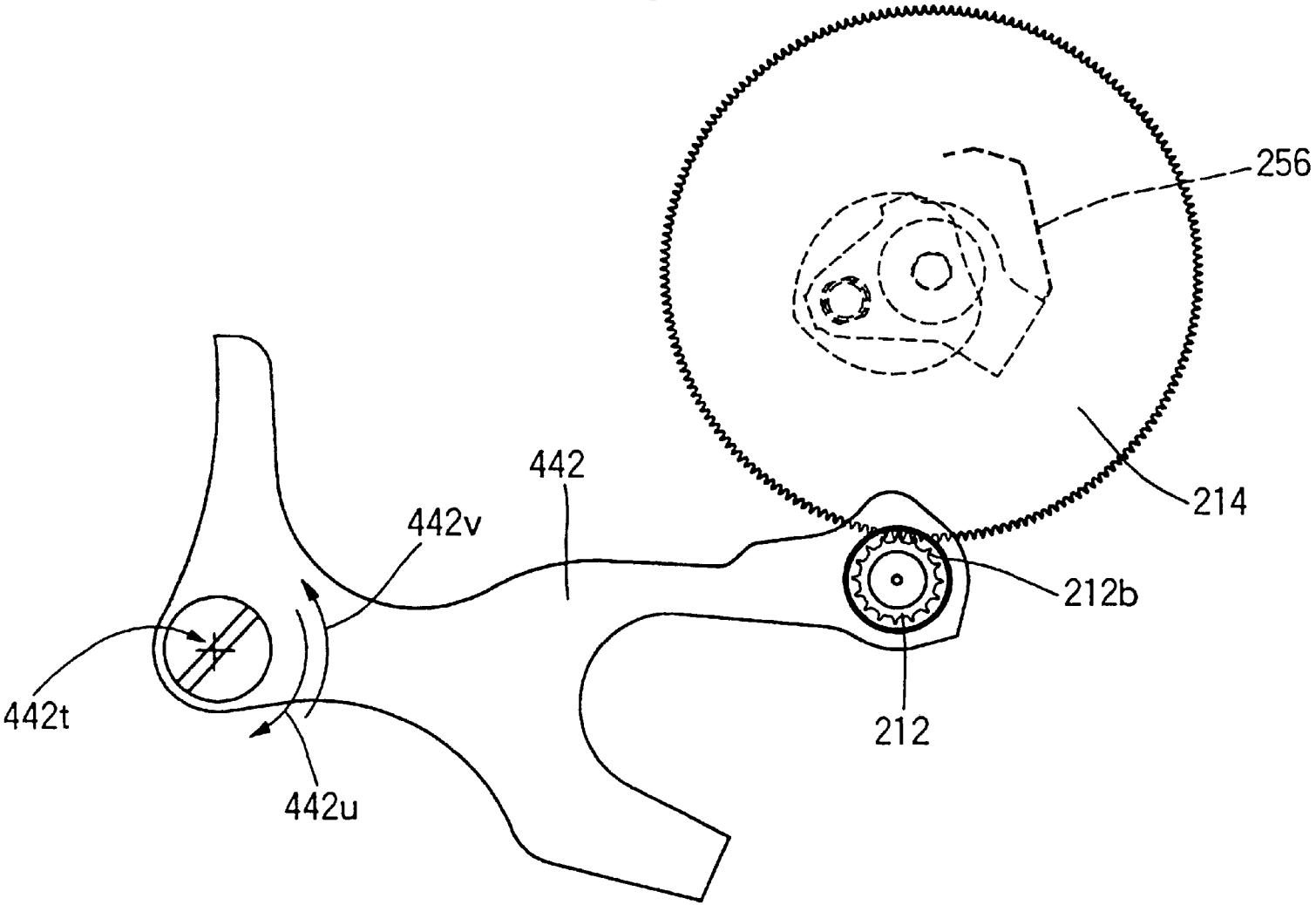
FIG. 15 is an outline partial enlarged plane view showing the coupling portion of the chronograph mechanism in the state in which the chronograph mechanism is operated according to the embodiment of the chronograph time piece of the invention.

In reference to FIG. 14 and FIG. 15, in the state in which the chronograph mechanism is operated in the chronograph time piece according to the invention, the coupling lever 442 is moved to rotate in the direction of the arrow mark 442*v* centering on the rotational center 442*t* such that the chronograph mechanism is operated. As a result, the second counting transmission pinion 212*b* is constituted to be in mesh with the second counting wheel 214. In the state in which the second counting transmission pinion 212*b* and the second counting wheel 214 are in mesh with each other, the second counting wheel 214 is constituted to rotate by one rotation per minute.

A guide frame 442*d* is provided to the coupling lever 442. An upper frame 442*e* is attached to the guide frame 442*d*. The upper frame 442*e* guides rotatably an upper shaft portion of the second counter intermediate wheel 212. By bringing an outer peripheral portion 442*f* of the guide frame 442*d* into contact with a contact portion 202*d* of the chronograph bridge 202, rotation of the coupling lever 442 in the direction of the arrow mark 442*v* is set. Therefore, by the constitution, the state in which the second counting transmission pinion 212*b* and the second counting wheel 214 are in mesh with each other can be maintained with certainty.

The chronograph second hand 118 is attached to the second counting wheel 214 and is constituted to display a result of measurement of an elapse time period of second.

By the constitution explained above, according to the chronograph time piece of the invention, the chronograph second hand 118 constituting the chronograph second display member, displays the result of measurement of the elapse time period of "second", the chronograph minute hand 124 constituting the chronograph minute display member, displays the result of measurement of the elapse time period of "minute" and the chronograph hour hand 128 constituting the chronograph hour display member, displays the result of measurement of the elapse time period of "hour".

Figure 16:
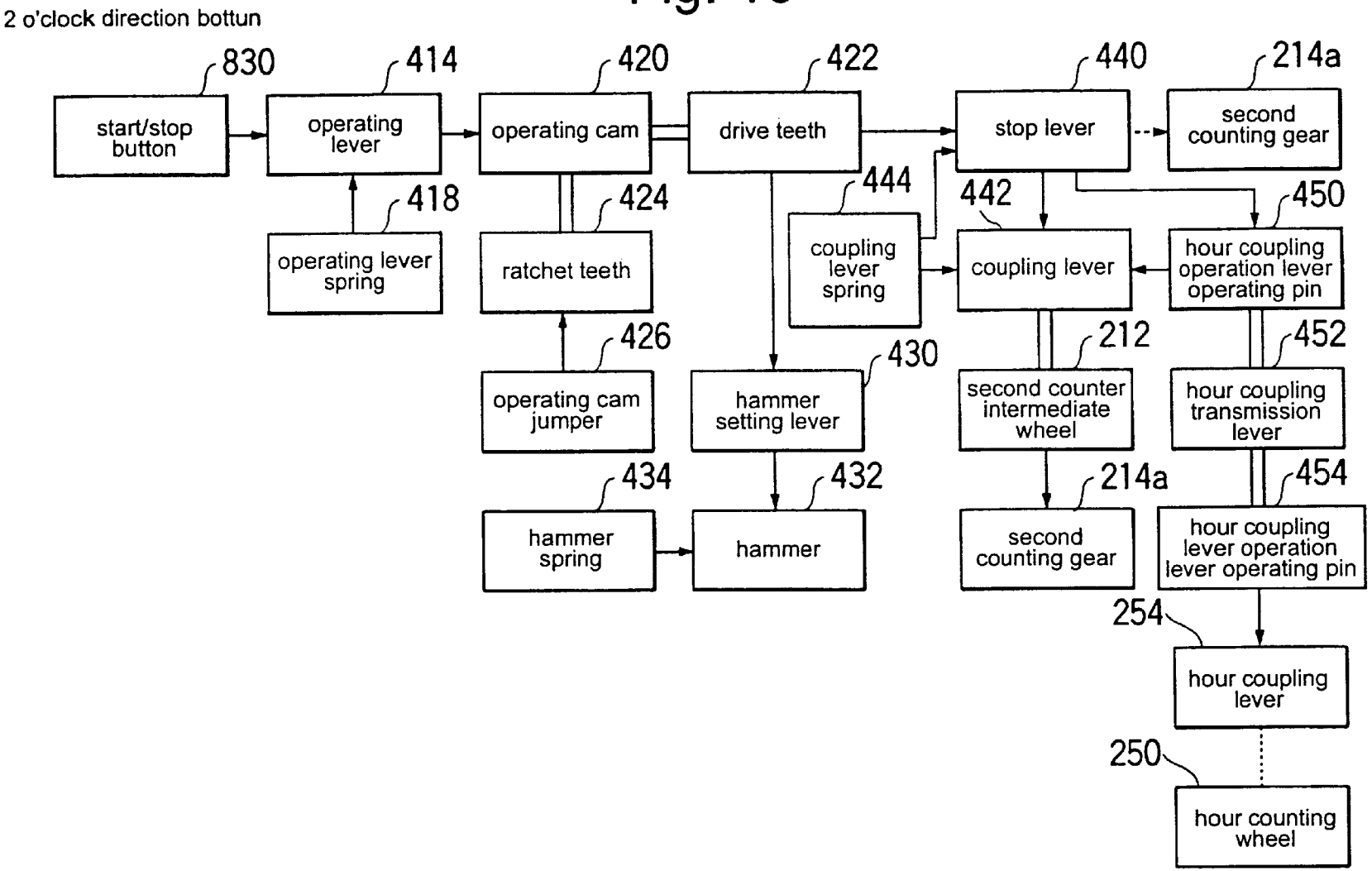
FIG. 16 is a functional block diagram showing a constitution of a coupling mechanism in a state in which the chronograph mechanism is not operated according to an embodiment of a chronograph time piece of the invention.

(2) Structure and operation of a chronograph operating mechanism (2-1) Constitutions of respective parts prior to the chronograph measurement operating An explanation will be given of the structure of a chronograph operating mechanism on the front side of the movement 100 according to an embodiment of a chronograph time piece of the invention in reference to FIGS. 16–18.

In 2 o'clock direction of the movement, a start/stop button 830 is provided and by pushing the start/stop button in a direction designated by an arrow mark 410, an operating lever 414 is constituted to be able to move.

Further, in 4 o'clock direction of the movement, a reset button 840 is provided and by pushing the reset button 840 in a direction designated by an arrow mark 412, an hour hammer operating lever 510 is constituted to be able to move.

Here, according to the specification, for convenience of explanation, in a plane view, when a set screw for setting a member is illustrated and a rotational center of the member or a pin constituting a guide cannot be illustrated, a center position of the set screw is indicated by a cross in the drawing and a reference notation of the pin is attached to the cross to thereby display the position of the pin.

Figure 17:
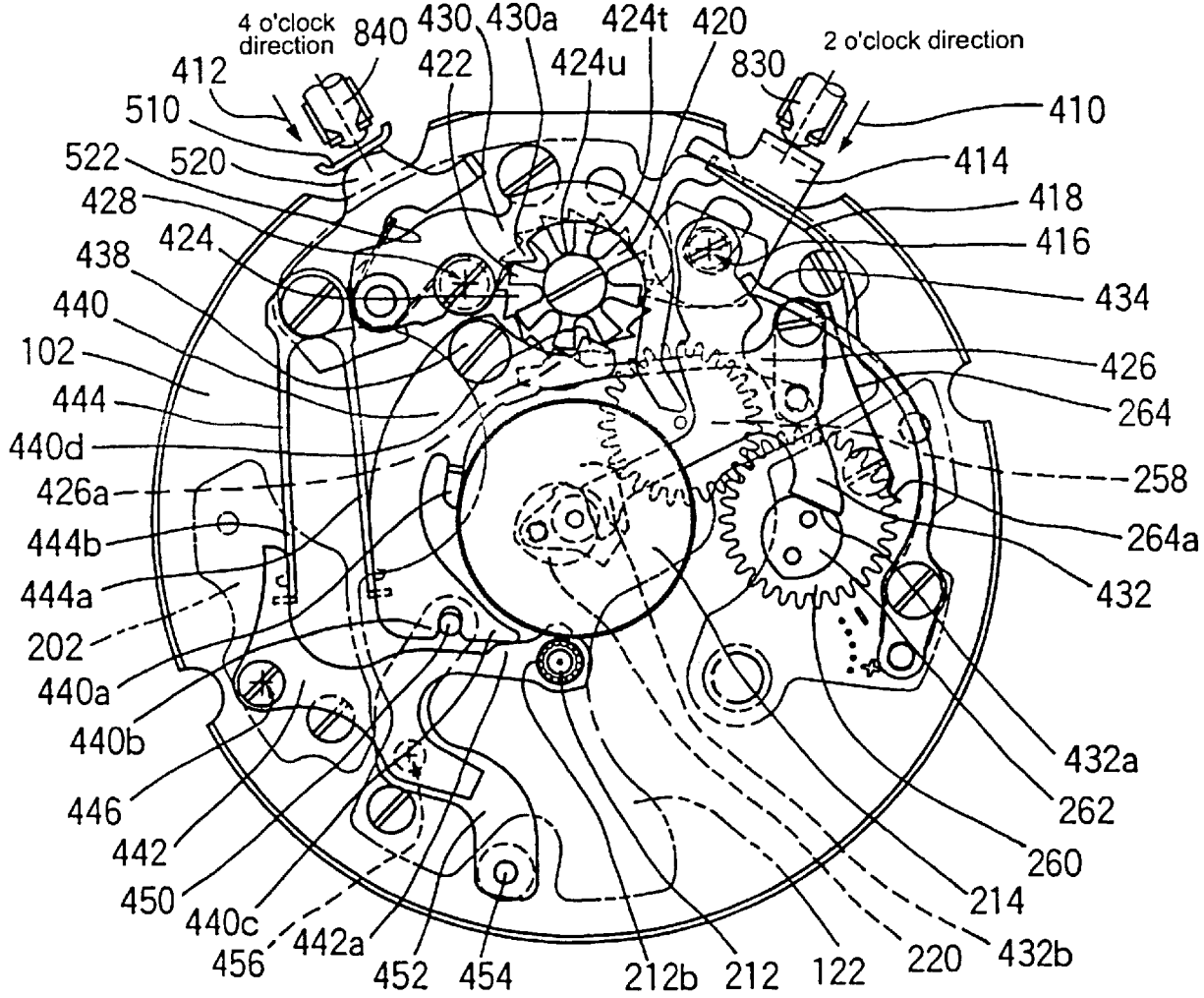
FIG. 17 is an outline plane view showing a front side of a movement in a state in which the chronograph mechanism is not operated according to the embodiment of the chronograph time piece of the invention.

The operating lever 414 is provided to be movable by being guided by an operating lever guide pin 416 (the center position is indicated by 416 in FIG. 17).

An operating lever spring 418 urges to push the operating lever 414 to the start/stop button 830. Therefore, after pushing the start/stop button 830, when the finger is detached from the start/stop button 830, by spring force of the operating lever spring 418, the operating lever 414 moves toward an outer side of the movement and the start/stop button 830 returns to the original position.

Similar operation is applicable also to the reset button 840 by using a hammer operating lever spring 522 and after pushing the reset button 840, when the finger is detached from the reset button 840, by spring force of the hammer operating lever spring 522, the hammer operating lever 520 moves toward the outer side of the movement and the reset button 840 returns to the original position.

An operating cam 420 is rotatably provided with drive teeth 422 and ratchet teeth 424. In the case of the ratchet teeth 424, the number of teeth is 16. In the case of the drive teeth 422, the number of teeth is 8 which is a half of the number of teeth of the ratchet teeth 424. Therefore, when the ratchet teeth 424 are fed by 1 pitch, the drive teeth 422 are fed by a half pitch. Viewing a portion in correspondence with an outer periphery of the drive teeth 422, every time of feeding the ratchet teeth 424 by 1 pitch, peak portions 424*t* and valley portions 424*u* of the drive teeth 422 are rotated to dispose alternately.

So far as the number of teeth of the ratchet teeth 424 is twice as much as the number of teeth of the drive teeth 422, the number of teeth of the ratchet teeth 424 need not be 16. However, the number of teeth of the ratchet teeth 424 is an even number.

There is provided an operating cam jumper 426 having a spring portion and a setting portion 426*a* sets the ratchet teeth 424 and determines a position of the operating cam 420 with regard to the rotational direction. Therefore, by the ratchet teeth 424 and the operating cam jumper 426, the operating cam 220 is rotated by every 360/16 degree and is positioned at the position with certainty.

A hammer setting lever 430 is rotatably provided centering on a hammer setting lever rotation guide pin 428 (center position is designated by 428 in FIG. 17). A setting portion 430*a* of the hammer setting lever 430 is disposed between 2 teeth of the drive teeth 422.

A hammer 432 is rotatably provided centering on the operating lever guide pin 416 (center position is indicated by 416 in FIG. 17). A hammer spring 434 urges the hammer 432 such that the hammer 432 is rotated in the clockwise direction. A minute zeroing portion 432*a* of the hammer 432 is brought into contact with the minute heart cam 262 of the minute counting wheel 260 and zeros the minute heart cam 262. Therefore, under the state, the chronograph minute hand 124 indicates "zero position".

A minute jumper 264 is provided with a setting portion 264*a* and the setting portion 264*a* sets a gear portion of the minute chronograph wheel 260. Therefore, a position of the minute chronograph wheel 260 in the rotational direction is set by the minute jumper 264.

A second zeroing operating portion 432*b* of the hammer 432 is brought into contact with the second heart cam 220 of the second chronograph wheel 214 to thereby return the second heart cam 220 to zero. Therefore, under the state, the chronograph second hand 118 indicates "zero position".

A stop lever 440 is rotatably provided centering on a stop lever rotation guide pin 438 (center position is indicated by 438 in FIG. 17). The stop lever 440 is provided with a second counting wheel contact portion 440*a,* an hour coupling lever pin operating portion 440*b,* a coupling lever contact portion 440*c* and a setting portion 440*d.* The setting portion 440*d* of the stop lever 440 is positioned between 2 teeth of the drive teeth 422.

There is provided a coupling lever spring 444 having a stop lever spring portion 444*a* and a coupling lever spring portion 444*b.* The coupling lever spring portion 444*b* urges the stop lever 440 in the counterclockwise direction and the second counting wheel contact portion 440*a* is brought into contact with a gear of the second counting wheel 214.

The coupling lever 442 is rotatably provided centering on a coupling lever rotation guide pin 446 (center position is indicated by 446 in FIG. 17). As described above, the guide frame 442*d* is provided to the coupling lever 442 and the upper frame 442*e* is attached to the guide frame 442*d.* The upper frame 442*e* rotatably guides the upper shaft portion of the second counter intermediate wheel 212. By spring force of the coupling lever spring portion 444*b,* the coupling lever 442 is urged to rotate in the counterclockwise direction. By bringing a contact portion 442*a* of the coupling lever 442 into contact with the coupling lever contact portion 440*c* of the stop lever 440, a position of the coupling lever 442 in the rotational direction is determined. In the state shown by FIG. 17, the second counting transmission pinion 212*b* of the second counter intermediate wheel 212 is not in mesh with the second counting wheel 214.

An hour coupling transmission lever 452 is rotatably provided centering on an hour coupling operation lever rotation guide pin 456 (center position is indicated by 456 in FIG. 17). The hour coupling operation lever 452 is provided with an hour coupling operation lever operating pin 450 and an hour coupling lever operation lever operating pin 454. The hour coupling operation lever operating pin 450 is engaged with the hour coupling lever pin operating portion 440*b* of the stop lever 440. Therefore, a position of the hour coupling operation lever 452 in the rotational direction is determined by the stop lever 440.

In FIG. 17, the rotational center of the minute counting wheel 260 is disposed substantially in "12 o'clock direction" of the movement. The rotational center of the minute counter intermediate wheel 258 is disposed between "12 o'clock direction" and "3 o'clock direction" of the movement. The rotational center of the operating cam 420 is disposed substantially in "3 o'clock direction". The rotational center of the second counter intermediate wheel 212 is disposed substantially in "9 o'clock direction" of the movement. The contact portion 442*a* of the coupling lever 442 is disposed substantially in "6 o'clock direction" of the movement. The coupling lever 442 and the hour coupling operation lever 452 are disposed between "6 o'clock direction" and "9 o'clock direction" of the movement. The hammer 432 is disposed between "12 o'clock direction" and "3 o'clock direction" of the movement.

Figure 18:
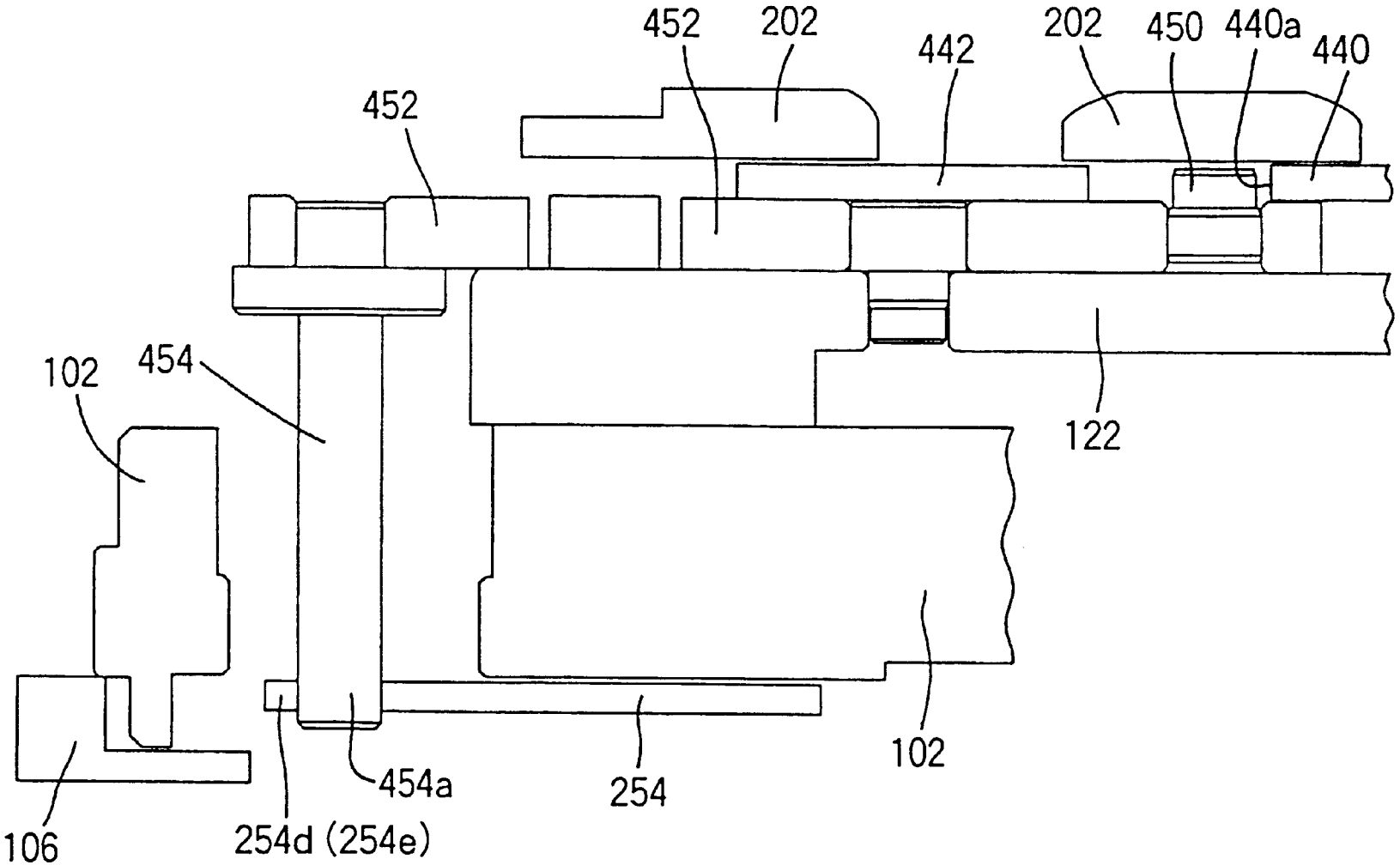
FIG. 18 is an outline partial sectional view showing an hour coupling lever, an hour coupling operation lever and an hour coupling lever operating pin according to an embodiment of a chronograph time piece of the invention.

In reference to FIG. 18, the coupling lever operation lever operating pin 454 is arranged to penetrate a portion of the main plate 102 from the front side of the movement to the back side of the movement. The hour coupling lever operation lever operating pin 454 is provided with an hour coupling lever operating portion 454*a.* The hour coupling lever operating portion 454*a* is constituted to be able to engage with the hour coupling lever 254. The hour coupling lever operation lever operating pin 454 is disposed substantially in "9 o'clock direction" of the movement.

Figure 19:
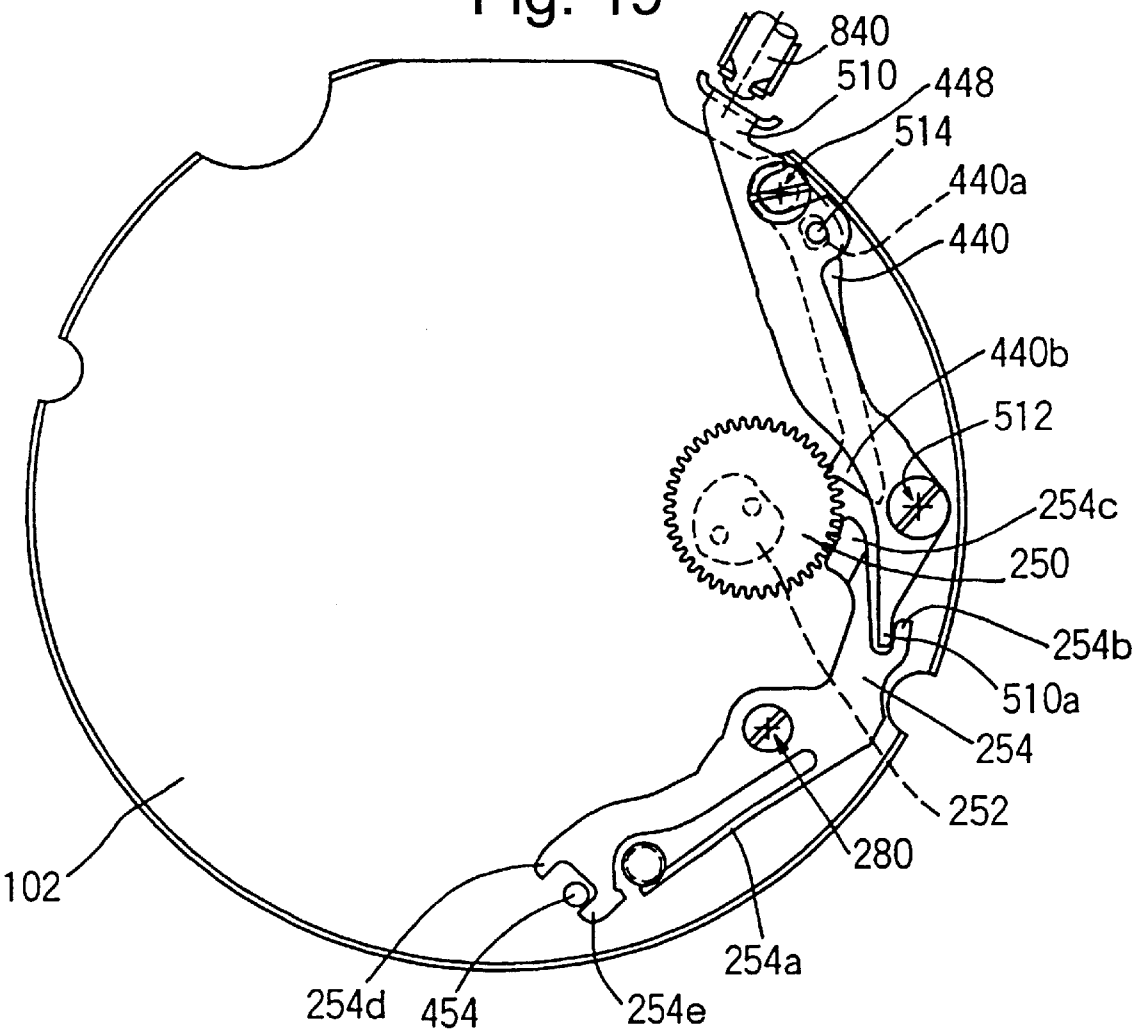
FIG. 19 is an outline partial plane view showing a back side of the movement in a state in which the chronograph mechanism is not operated according to the embodiment of the chronograph time piece of the invention.

In reference to FIG. 19, the hour coupling lever 254 is rotatably provided centering on an hour coupling lever rotation guide pin 280 (center position is indicated by 280 in FIG. 19). The hour coupling lever 254 is provided with an hour coupling lever spring portion 254*a,* an hour hammer transmission lever operating portion 254*b,* an hour counting wheel contact portion 254*c,* a first pin engaging portion 254*d* and a second pin engaging portion 254*e.* The first pin engaging portion 254*d* is disposed more proximate to the inner side of the movement than the second pin engaging portion 254*e.*

By spring force of the hour coupling lever spring portion 254*a,* the hour coupling lever 254 is urged to rotate in the counterclockwise direction. In the state shown by FIG. 19, the hour counting wheel contact portion 254*c* is brought into contact with a gear portion of the hour counting wheel 250.

An hour hammer transmission lever 510 is rotatably provided centering on an hour hammer transmission lever rotation guide pin 512 (center position is indicated by 512 in FIG. 19). The hour hammer transmission lever 510 is provided with an hour hammer lever operating pin 514 and an hour coupling lever engaging portion 510*a.* The hour hammer 440 is provided rotatably centering on an hour hammer rotation guide pin 448 (center position is indicated by 448 in FIG. 19).

The hour hammer 440 is provided with the hour hammer operating pin engaging portion 440*a* and the hour zeroing portion 440*b.* The hour hammer operating pin 514 of the hour hammer transmission lever 510 is engaged with the hour hammer operating pin engaging portion 440*a* and a position of the hour hammer 440 in the rotational direction is determined. It is preferable to constitute the hour hammer operating pin engaging portion 440*a* in a shape of a long hole.

By operating the reset button 840, the hour zeroing portion 440*b* of the hour hammer 440 is brought into contact with the hour heart cam 252 of the hour counting wheel 248 to thereby zero the hour heart cam 252. Therefore, under the state, the chronograph hour hand 128 indicates "zero position". In the state shown by FIG. 19, the hour zeroing portion 440*b* of the hour hammer 440 is disposed to be remote from the heart cam 252.

(2-2) Operation in chronograph measurement

Figure 20:
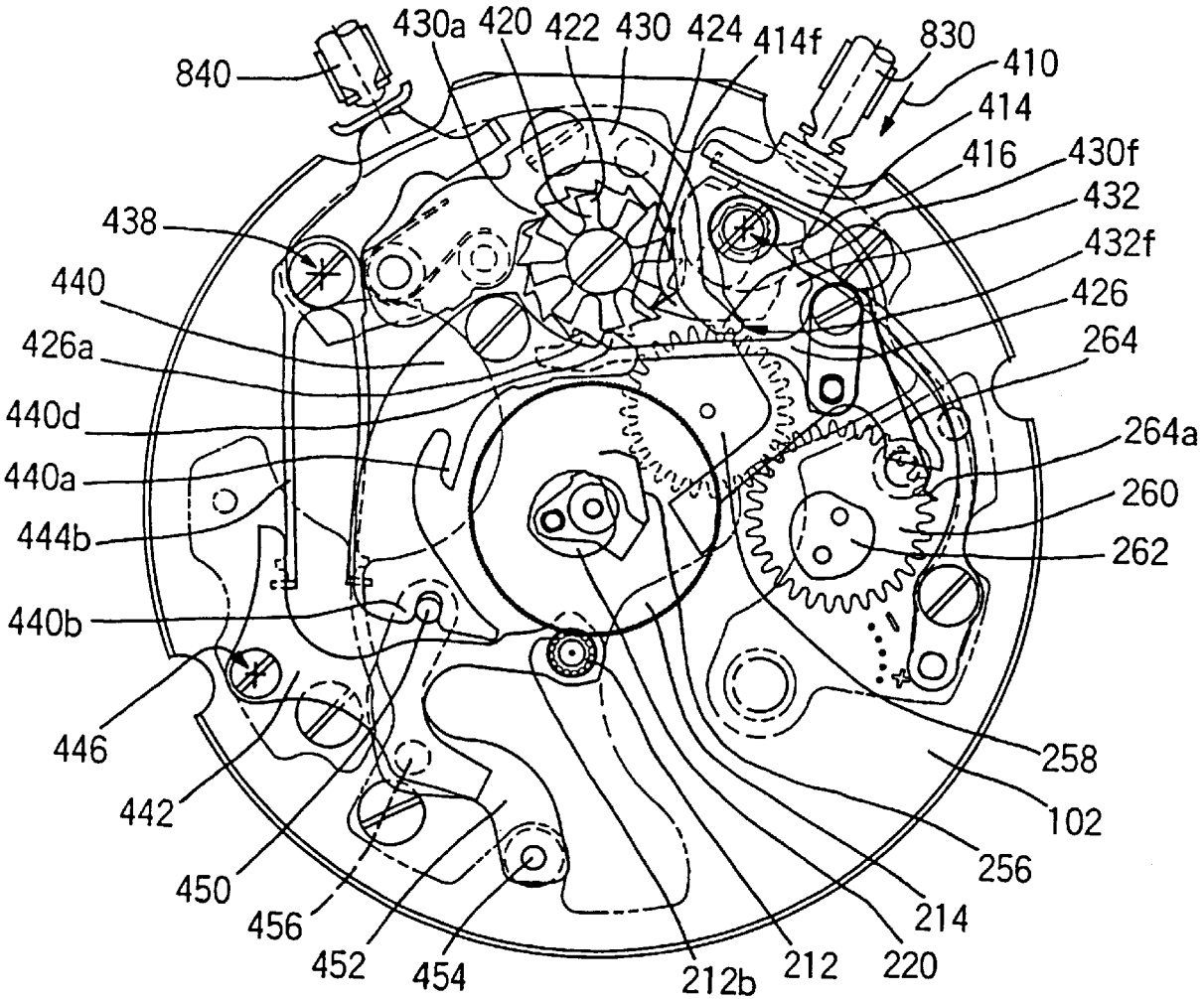
FIG. 20 is an outline partial plane view showing the front side of the movement in a state in which the chronograph mechanism is started according to the embodiment of the chronograph time piece of the invention.

Next, in reference to FIG. 20, the start/stop button 830 disposed in 2 o'clock direction of the movement is pushed in the direction of the arrow mark 410. When the chronograph time piece is set to a chronograph measurement mode, the operating lever 414 is guided by the operating lever guide pin 416 and is slidably moved toward the inner side of the movement against spring force of the operating lever spring 418.

By the slidable movement of the operating lever 414, an operational end portion 414*f* of the operating lever 414 rotates the ratchet teeth 424 of the operating cam 420 by one tooth in the clockwise direction. The position of the ratchet teeth 424 in the rotational direction is positioned by the setting portion 426*a* of the operating cam jumper 426.

The number of teeth of the ratchet teeth 424 is 16 while the number of teeth of the drive teeth 422 is B. Accordingly, when the ratchet teeth 424 are rotated by one tooth, the drive teeth 422 are also rotated by a half pitch in the clockwise direction. Therefore, by rotating the drive teeth 422, the hammer setting lever 430 is rotated in the counterclockwise direction while centering on the hammer setting lever rotation guide pin 428 and the positioning portion 430*f* of the hammer setting lever 430 is engaged with the setting portion 432*f* of the hammer 432. As a result, the hammer setting lever 430 is mounted on the outer peripheral face of the peak portion 424*t* and is held in the state shown by FIG. 20.

By such rotation of the hammer setting lever 430, the setting portion 432*f* of the hammer 432 is pushed and the hammer 432 is rotated in the counterclockwise direction centering on the operating lever guide pin 416. As a result, the minute zeroing portion 432*a* of the hammer 432 is separated from the minute heart cam 262 of the minute counting wheel 260. Therefore, under the state, the chronograph minute hand 124 is rotated and "minute" of the result of measurement of the chronograph can be displayed.

Further, since the hammer 432 is rotated in the counterclockwise direction, the second zeroing portion 432*b* of the hammer 432 is separated from the second heart cam 220 of the second counting wheel 214.

By rotating the drive teeth 422, the stop lever 440 is rotated in the clockwise direction centering on the stop lever rotation guide pin 438. Further, as described above in reference to FIG. 14, the outer peripheral portion 442*f* of the guide frame 442*d* is brought into contact with the contact portion 202*d* of the chronograph bridge 202 to thereby set the position of the coupling lever 442 in the rotational direction. Under the state, the stop lever 440 is held to be separated from the coupling lever 442.

The stop lever 440 mounts on the outer peripheral face of the peak portion 424*t* of the drive teeth 422 and is held in the state shown by FIG. 20. Therefore, the second counting wheel contact portion 440*a* is separated from the gear of the second counting wheel 214. Therefore, under the state, the chronograph second hand 118 is rotated and "second" of the result of measurement of the chronograph can be displayed.

By rotating the stop lever 440, the coupling lever 442 is rotated in the counterclockwise direction centering on the coupling lever rotation guide pin 446. As described above, by the spring force of the coupling lever spring portion 444*b*, the coupling lever 442 is always urged to rotate in the counterclockwise direction.

Therefore, under the state, the state in which the second counting transmission pinion 212*b* and the second counting wheel 214 are in mesh with each other is maintained with certainty.

Therefore, the second counting wheel 214 can be rotated and measurement of "second" and "minute" of the chronograph is started.

Based on rotation of the barrel complete 110, the second counting wheel 214 is rotated via rotation of the center wheel & pinion 130, the third wheel & pinion 136, the second wheel 154 and the second counter intermediate wheel 212. The number of teeth of the train wheel of the second counting wheel 214 is set such that the second counting wheel 214 is rotated by one rotation per minute.

Every time of rotating the second counting wheel 214 by one rotation, the minute counter intermediate wheel 258 is rotated by one tooth by the minute driving finger 256. The minute counting wheel 260 is rotated by rotation of the minute counter intermediate wheel 258 and after elapse of one minute, the chronograph minute hand 124 is rotated by an angle in correspondence with one minute of the minute chronograph indicator. The position of the minute chronograph wheel 260 in the rotational direction is set by the minute jumper 264.

Further, by rotating the stop lever 440, the hour coupling lever operating pin 450 engaged with the hour coupling lever pin operating portion 440*b* is rotated and the hour coupling operation lever 452 is rotated in the counterclockwise direction centering on the hour coupling operation lever rotation guide pin 456. As a result, the hour coupling lever operating pin 454 is also rotated in the counterclockwise direction.

As described above in reference to FIG. 18, the hour coupling lever operating pin 454 penetrates a portion of the main plate 102 from the front side of the movement to the back side of the movement.

Figure 21:
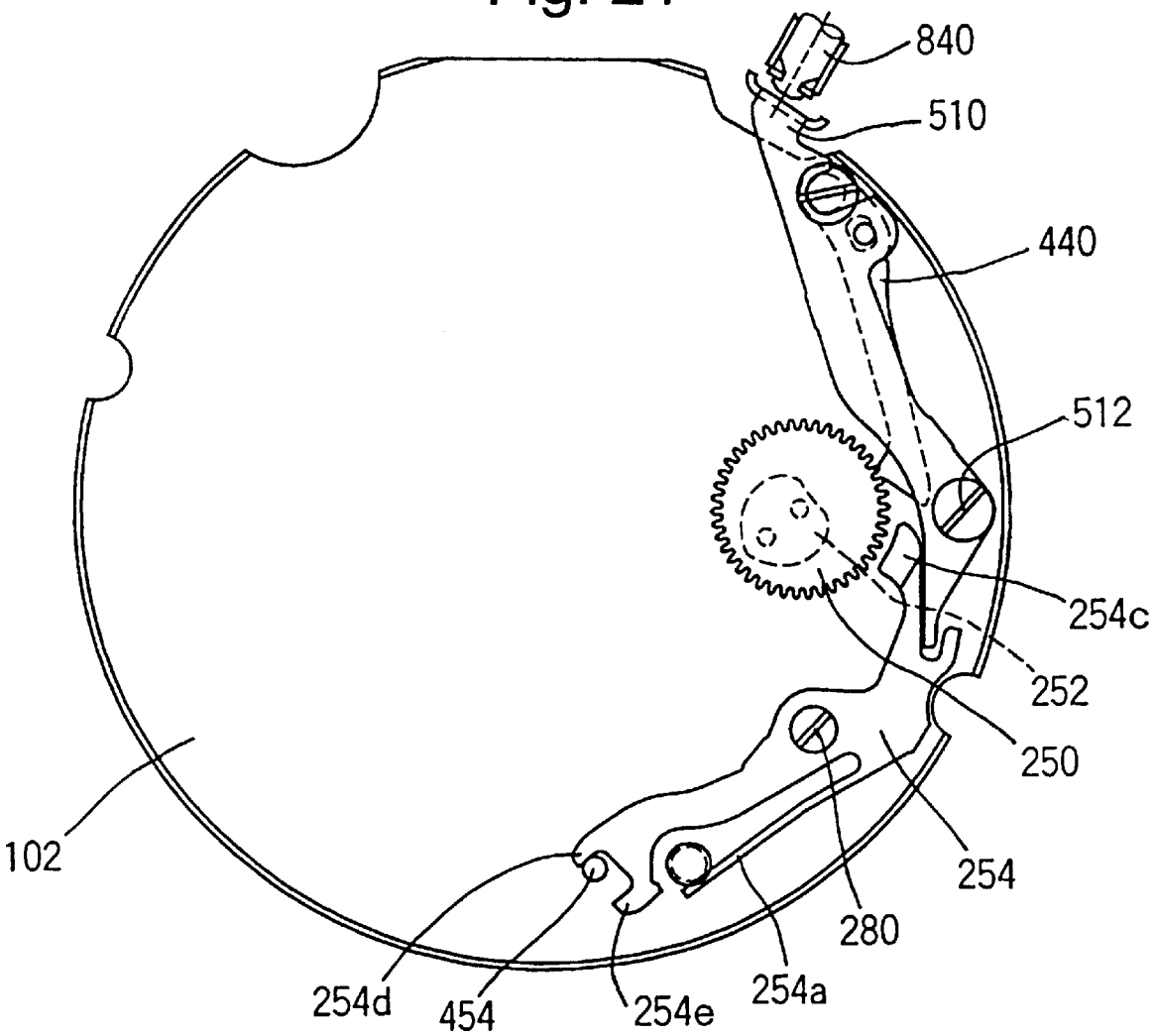
FIG. 21 is an outline partial plane view showing the back side of the movement in the state in which the chronograph mechanism is started according to the embodiment of the chronograph time piece of the invention.

In reference to FIG. 21, when the hour coupling lever operating pin 454 is rotated, the first engaging portion 254*d* is pushed. Therefore, the hour coupling lever 254 is rotated centering on the hour coupling lever rotation guide pin 280 in the clockwise direction against the spring force of the hour coupling lever spring portion 254*a*. As a result, the hour counting wheel contact portion 254*c* is separated from the gear portion of the hour counting wheel 250. Therefore, under the state, the hour counting wheel 250 can rotate, the chronograph hour hand 128 is rotated and "hour" of the result of measurement of the chronograph can be displayed.

Figure 22:
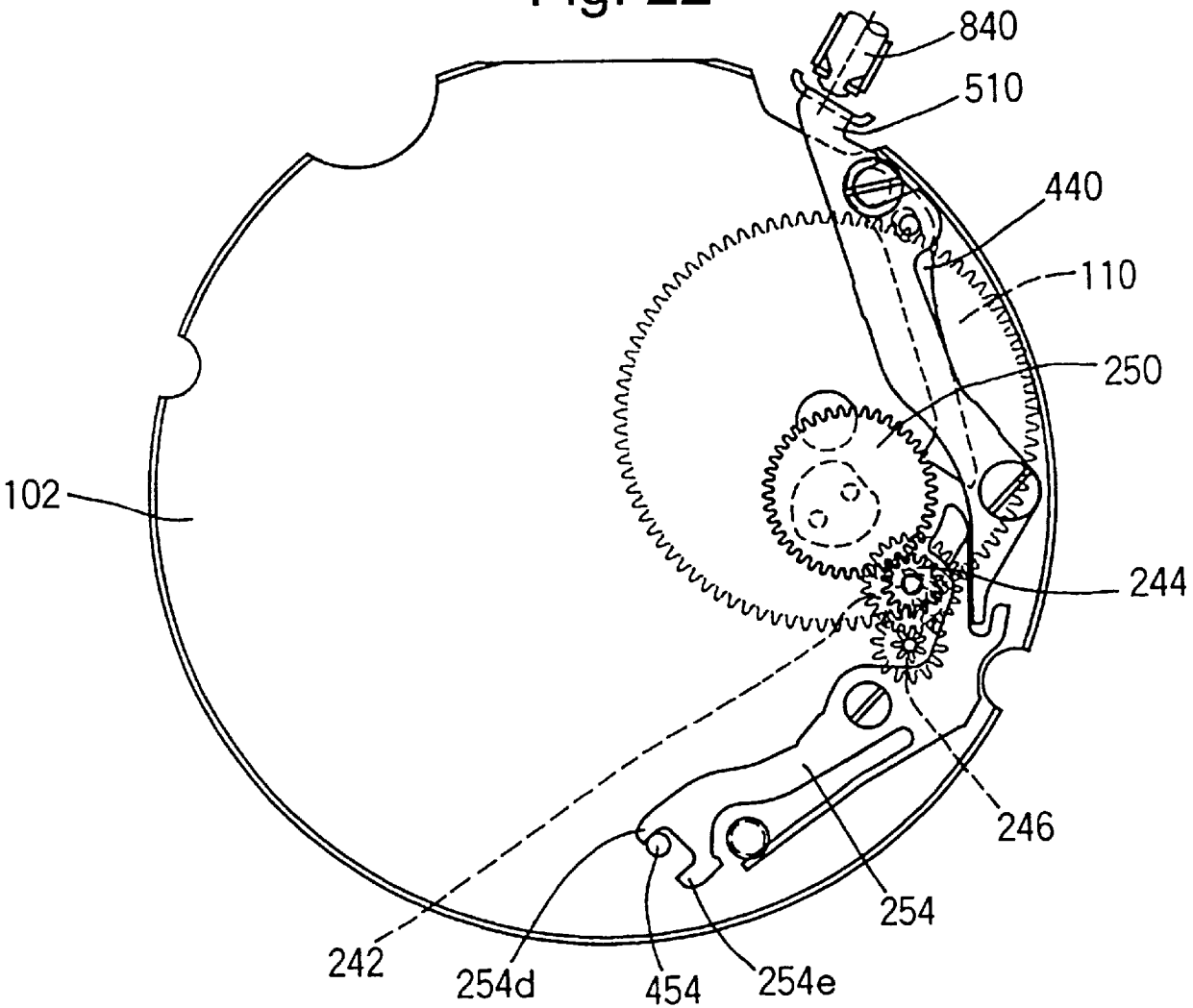
FIG. 22 is an outline partial plane view showing an hour counting train wheel in the state in which the chronograph mechanism is started according to the embodiment of the chronograph time piece of the invention.

In reference to FIG. 22, the hour counting transmission wheel (A) 246 is rotated based on rotation of the barrel complete 110. The hour counting transmission wheel (C) 242 is rotated based on rotation of the hour counting transmission wheel (A) 246. The hour counting transmission wheel (B) 244 is rotated integrally with the hour counting transmission wheel (C) 242. By rotating the hour counting transmission wheel (B) 244, the hour counter wheel 250 is rotated. Therefore, after elapse of one hour, the chronograph hour hand 128 is rotated by an angle in correspondence with one hour of the hour chronograph indicator.

(2-3) Operation in stopping chronograph measurement

Figure 23:
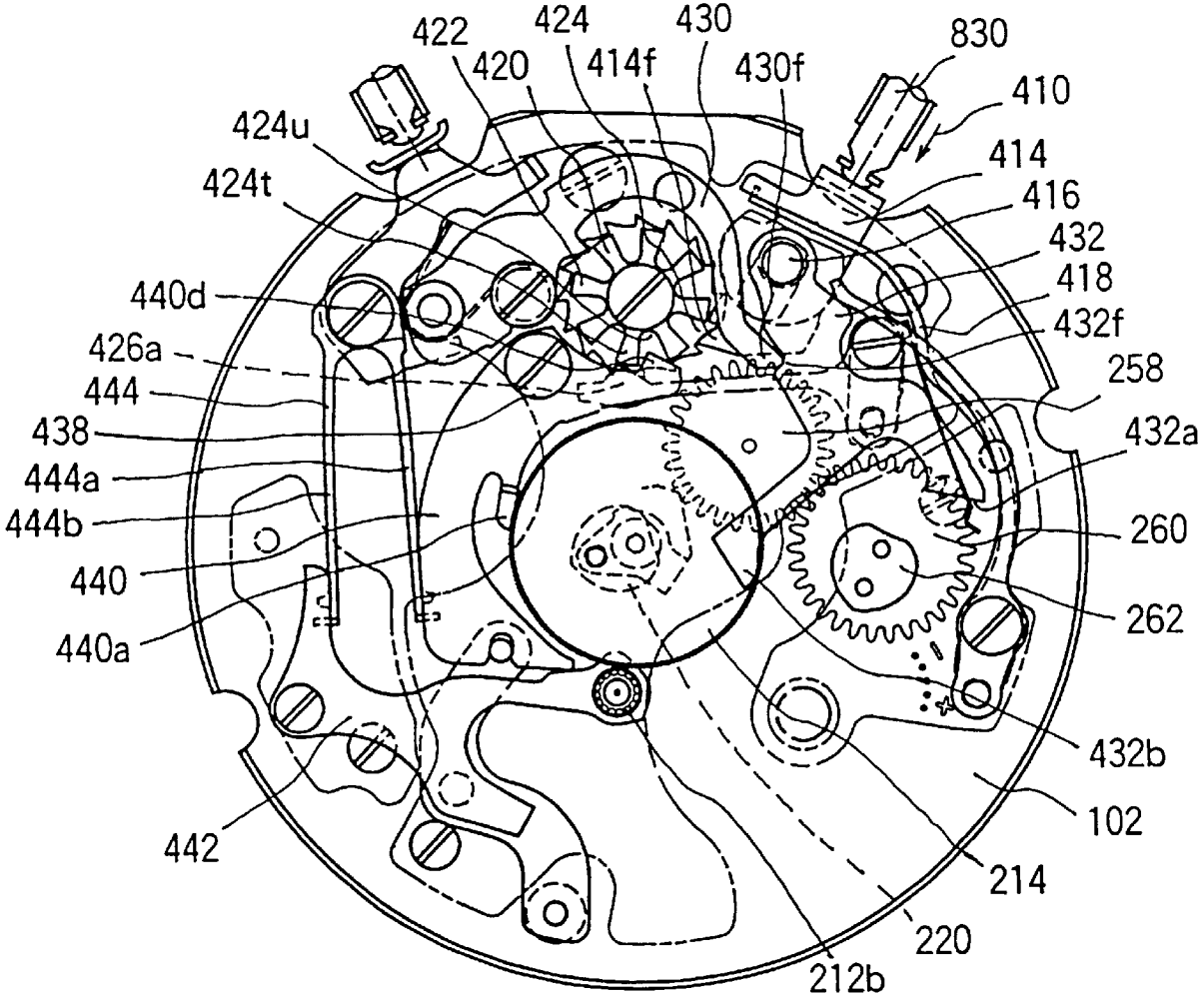
FIG. 23 is an outline plane view showing the front side of the movement in a state in which the chronograph mechanism is stopped according to the embodiment of the chronograph time piece of the invention.

In reference to FIG. 23, in the state of operating the chronograph measurement, the start/stop button disposed in 2 o'clock direction of the movement is pushed in the direction of the arrow mark 410.

By the operation, the operating lever 414 is slidably moved toward the inner side of the movement against the spring force of the operating lever spring 418 while being guided by the operating lever guide pin 416.

By the slidable movement of the operating lever 414, the operational end portion 414*f* of the operating lever 414 rotates the ratchet teeth 424 of the operating cam 420 in the clockwise direction by further one tooth. The position of the ratchet teeth 424 in the rotational direction is positioned by the setting portion 426*a* of the operating cam jumper 426.

When the ratchet teeth 424 are rotated by one tooth, the drive teeth 422 are also rotated in the clockwise direction by further half pitch.

Also in this state, the positioning portion 430*f* of the hammer setting lever 430 stays to be engaged with the setting portion 432*f* of the hammer 432. As a result, the hammer setting lever 430 is held at the position as that in the state shown by FIG. 20.

Since the hammer setting lever 430 is not rotated, the minute zeroing portion 432*a* of the hammer 432 stays to be separated from the minute heart cam 262 of the minute counting wheel 260. Further, the second zeroing portion 432*b* of the hammer 432 stays to be separated from the second heart cam 220 of the second counting wheel 214.

Since the drive teeth 422 are rotated by a half pitch, the setting portion 440*d* of the stop lever 440 is positioned between two teeth of the drive teeth 422. Since, by the coupling lever spring portion 444*b*, the stop lever 440 is always urged in the counterclockwise direction, the stop lever 440 is rotated in the counterclockwise direction centering on the stop lever rotation guide pin 438. By rotating the stop lever 440, the coupling lever 442 is rotated in the counterclockwise direction. Therefore, the outer peripheral portion 442*f* of the guide frame 442*d* is separated from the contact portion 202*d* of the chronograph bridge 202. Under the state, the second counting transmission pinion 212*b* and the second counting wheel 214 are brought into out of mesh.

At the same time, the second counting wheel contact portion 440*a* of the stop lever 440 is brought into contact with a gear of the second counting wheel 214. Therefore, under the state, the rotation of the second counting wheel 214 is set. As a result, the chronograph second hand 118 is stopped and display of "second" of a result of measurement of the chronograph at the time point is maintained. Further, the chronograph minute hand 128 is also stopped at the same time, and display of "minute" of the result of measurement of the chronograph at the time point is maintained.

As described above, on the front side of the movement, by rotating the stop lever 440, the coupling lever 442 is rotated in the counterclockwise direction centering on the coupling lever rotation guide pin 446. As a result, on the back side of the movement, the hour coupling lever operating pin 454 is rotated in the counterclockwise direction toward the outer side of the movement.

Figure 24:
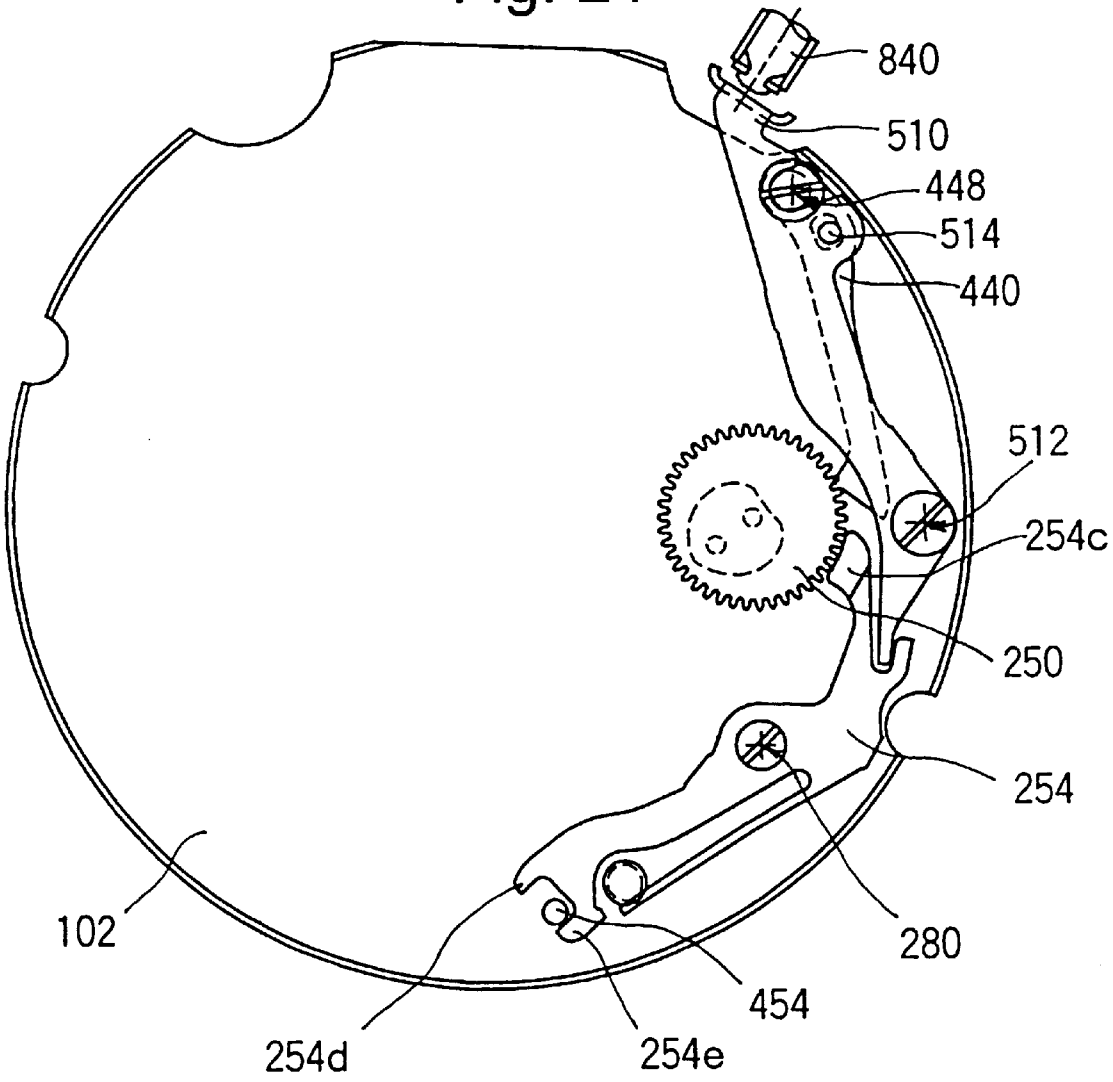
FIG. 24 is an outline partial plane view showing the back side of the movement in the state in which the chronograph mechanism is stopped according to the embodiment of the chronograph time piece of the invention.

In reference to FIG. 24, by the rotational movement of the hour coupling lever operating pin 454, the hour coupling lever 254 is rotated in the counterclockwise direction while centering on the hour coupling lever rotation guide pin 280. Therefore, the hour counting wheel contact portion 254*c* is brought into contact with the gear portion of the hour counting wheel 250.

When rotation of the hour counting wheel 250 is set, also the hour counting transmission wheel (B) cannot be rotated. Meanwhile, by rotation of the barrel complete 110, the hour counting transmission wheel (A) 246 is rotated and by rotating the hour counting transmission wheel (A) 246, the hour counting transmission wheel (C) 242 is rotated.

Therefore, the fitting portion 244*c* of the hour counting transmission wheel (C) 242 is slipped relative to the fitting portion 244*c* of the hour counting transmission wheel (B) 244. By the constitution, while maintaining rotation of the barrel complete 110, rotation of the hour counting wheel 250 can be stopped.

Therefore, under the state, the chronograph second hand 118, the chronograph minute hand 124 and the chronograph hour hand 128 are stopped in the state respectively displaying "second", "minute" and "hour" of an elapse time period from the start time point.

Further, by rotation of the barrel complete 110, the front train wheel continues operating and accordingly, by the hour hand 150, the minute hand 134 and the second hand 156, "hour", "minute" and "second" of current time can be displayed.

(2-4) Case of restarting measurement of chronograph

In the state of stopping the chronograph measurement shown by FIG. 23 and FIG. 24, by pushing again the start/stop button 830 in the direction of the arrow mark 410, the chronograph time piece can be set again to the chronograph measurement mode.

By the slidable movement of the operating lever 414, the operational end portion 414*f* of the operating lever 414 rotates the ratchet teeth 424 of the operating cam 420 by one tooth in the clockwise direction. By rotating the drive teeth 422, the hammer setting lever 430 is rotated in the counterclockwise direction centering on the hammer setting lever rotation guide pin 428 and the hammer setting lever 430 mounts on the outer peripheral face of the peak portion 424*t* of the drive teeth 422 and is held in the state shown by FIG. 20.

By such rotation of the hammer setting lever 430, the minute zeroing portion 432*a* of the hammer 432 is separated from the minute heart cam 262 of the minute counting wheel 260. Therefore, under the state, the chronograph minute hand 124 can be rotated again.

Further, since the hammer 432 is rotated in the counterclockwise direction, the second zeroing portion 432*b* of the hammer 432 is separated from the second heart cam 220 of the second counting wheel 214.

By rotating the drive teeth 422, the stop lever 440 is rotated in the clockwise direction centering on the stop lever rotation guide pin 438 and the stop lever 440 mounts on the outer peripheral face of the peak portion 424*t* of the drive teeth 422 and is held in the state shown by FIG. 20. Therefore, the second counting wheel contact portion 440*a* is separated from the gear of the second counting wheel 214. Therefore, under the state, the chronograph second hand 118 can be rotated again.

Further, by rotating the stop lever 440, the hour coupling lever operating pin 454 is rotated and the hour counting wheel contact portion 254*c* is separated from the gear portion of the hour counting wheel 250. Therefore, the hour counting wheel 250 can be rotated again.

(2-5) Reset operation

Figure 25:
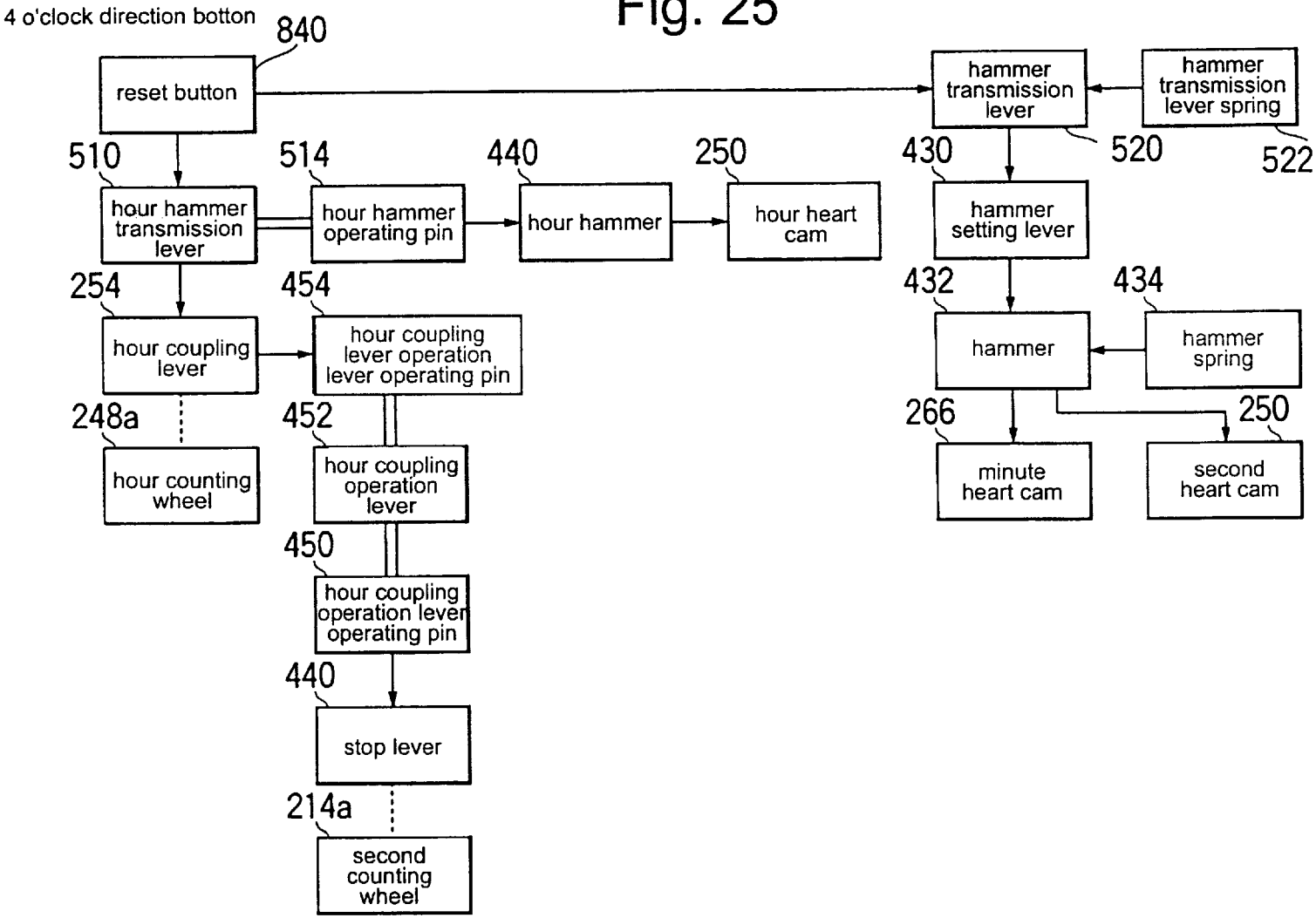
FIG. 25 is a functional block diagram showing a constitution of a reset mechanism according to an embodiment of a chronograph time piece of the invention.
Figure 26:
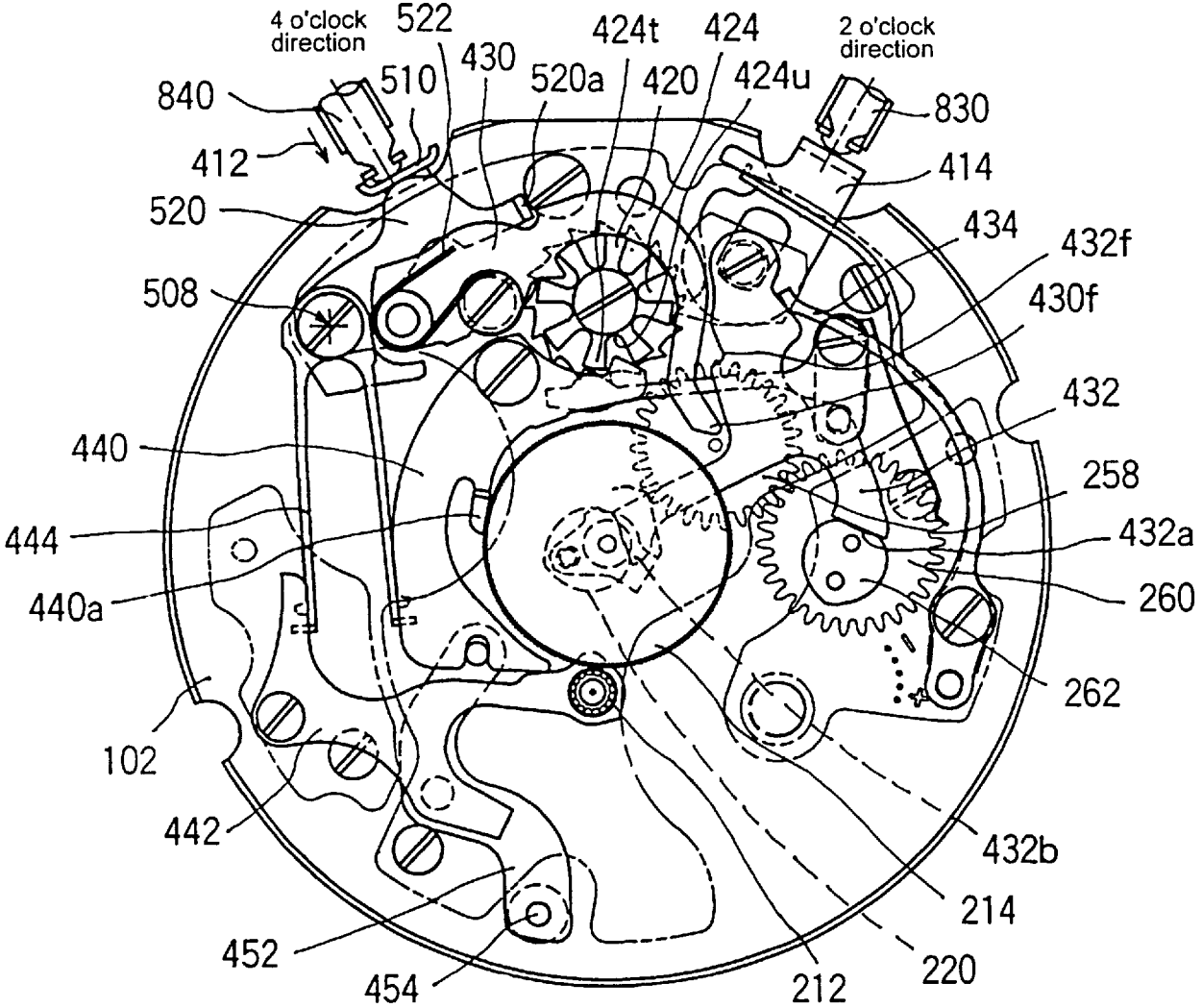
FIG. 26 is an outline plane view showing the front side of the movement in a state in which the chronograph mechanism is reset according to an embodiment of a chronograph time piece of the invention.
Figure 27:
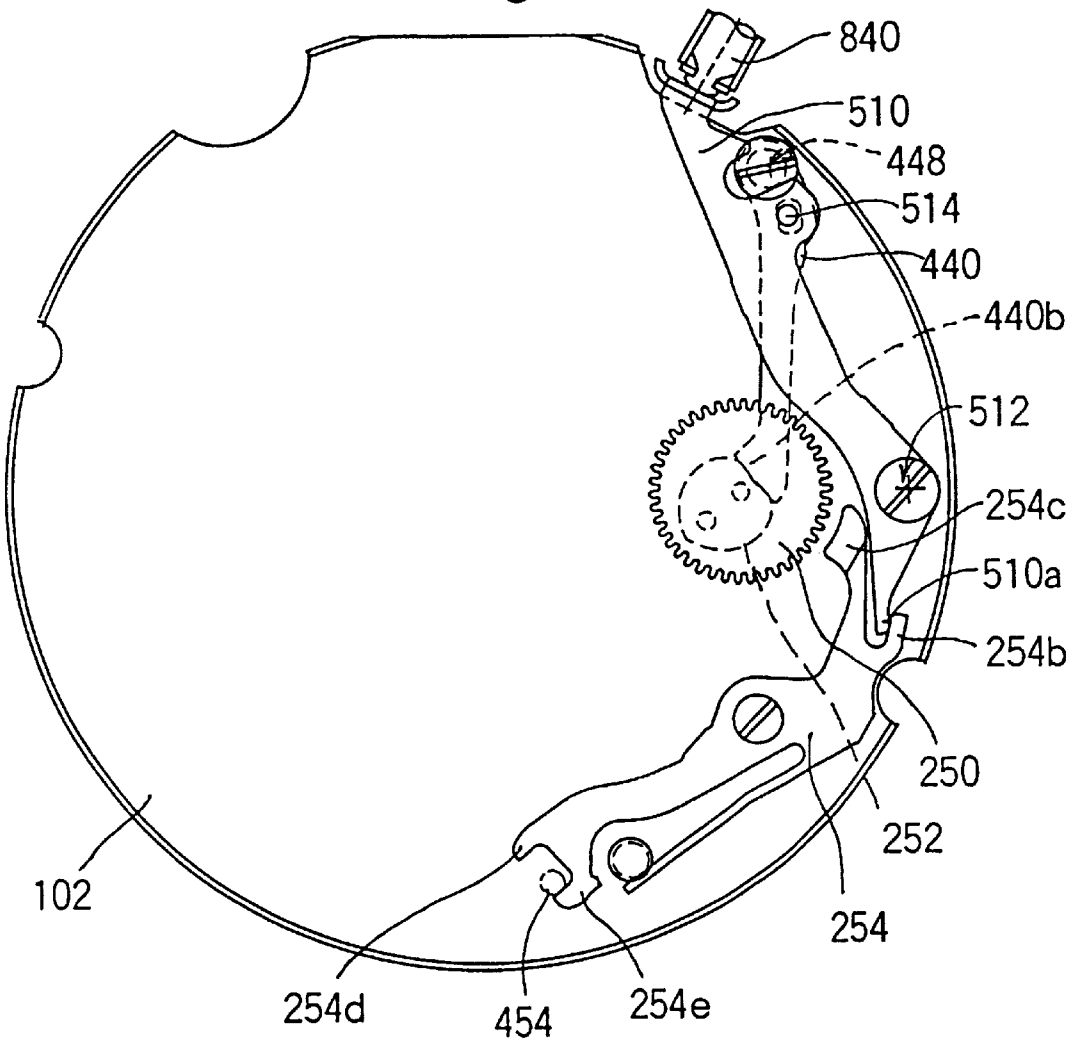
FIG. 27 is an outline partial plane view showing the back side of the movement in the state in which the chronograph mechanism is reset according to the embodiment of the chronograph time piece of the invention.

In reference to FIG. 25 through FIG. 27, in the state in which measurement of the chronograph is stopped, reset operation can be carried out by pushing the reset button 840 disposed in 4 o'clock direction of the movement in the direction designated by the arrow mark 412.

In reference to FIG. 25 and FIG. 27, when the reset button 840 is pushed, on the back side of the movement, the hour hammer transmission lever 510 is rotated in the counterclockwise direction and by the hour hammer operating pin 514, the hour hammer 440 is rotated in the clockwise direction. Then, the time zeroing portion 440*b* of the hammer 440 is brought into contact with the hour heart cam 252 of the hour counting wheel 248 to thereby zero the hour counting wheel 248.

At the same time, by rotating the hour hammer transmission lever 510, the hour coupling lever engaging portion

510*a* of the hour hammer transmission lever 510 is engaged with the hour hammer transmission lever operating portion 254*b* of the hour coupling lever 254 to thereby rotate the hour coupling lever 254 in the clockwise direction. Then, the hour counting wheel contact portion 254*c* is separated from the gear portion of the hour counting wheel 250.

Therefore, as a result of such reset operation, the chronograph hour hand 128 returns to and stops at "zero position" before starting to operate the chronograph mechanism.

Figure 28:
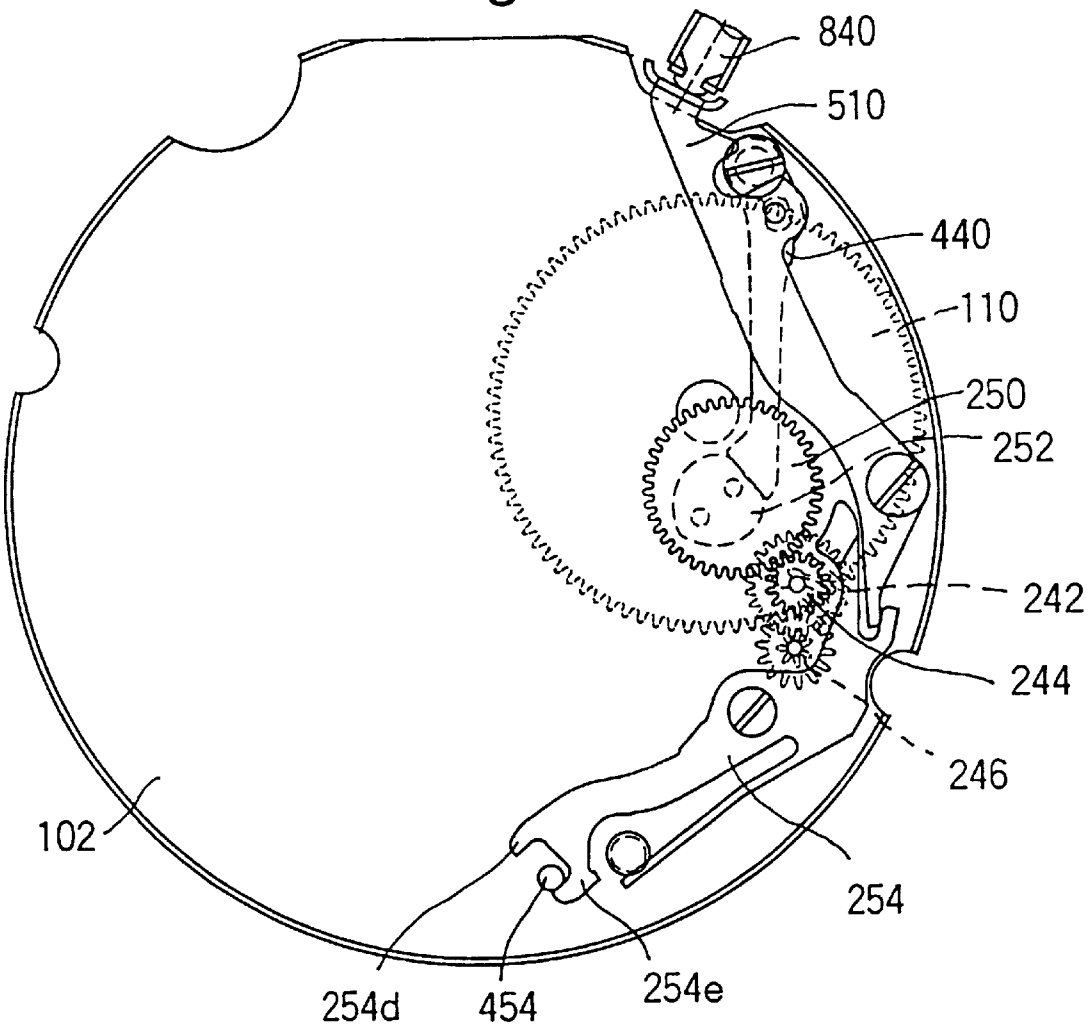
FIG. 28 is an outline partial plane view showing the hour counting train wheel in the state in which operation of the chronograph mechanism is reset according to the embodiment of the chronograph time piece of the invention.

In reference to FIG. 28, when rotation of the hour counting wheel 250 is set, also the hour counting transmission wheel (B) 244 cannot be rotated. Meanwhile, by rotation of the barrel complete 110, the hour counting transmission wheel (A) 246 is rotated and by rotation of the hour counting transmission wheel (A) 246, the hour counting transmission wheel (C) 242 is rotated.

Therefore, the fitting portion 244*c* of the hour counting transmission wheel (C) 242 is slipped relative to the fitting portion 244*c* of the hour counting transmission wheel (B) 244.

Further, in reference to FIG. 27, when the hour coupling lever 254 is rotated in the clockwise direction, the second contact portion 254*e* of the hour coupling lever 254 is rotated in the clockwise direction and the hour coupling lever operation lever operating pin is moved toward the inner side of the movement. Then, in reference to FIG. 26, the hour coupling operation lever 452 is rotated in the counterclockwise direction. Then, the hour coupling operation lever transmitting pin 450 provided to the hour coupling operation lever 452 is also rotated in the counterclockwise direction and the hour coupling operation lever transmitting pin 450 rotates the stop lever 440 in the clockwise direction. As a result, the second counting wheel contact portion 440*a* is separated from the gear of the second counting wheel 214. Under the state, the second counting transmission pinion 212*b* is not in mesh with the second counting wheel 214 and accordingly, the second counting wheel 214 is not rotated.

In reference to FIG. 25 and FIG. 26, on the front side of the movement, the hammer transmission lever 520 is rotatably provided centering on the hammer transmission lever rotation guide pin 508. The hammer transmission lever 520 is provided with the hammer setting lever engaging portion 520*a*. The hammer transmission lever spring 522 urges the hammer transmission lever 520 to rotate in the counterclockwise direction.

When the reset button 840 is pushed, the hammer transmission lever 520 is rotated in the clockwise direction via operation of the hour hammer transmission lever 510 and the hammer setting lever engaging portion 520*a* pushes the hammer setting lever 430. Then, the hammer setting lever 430 is rotated in the clockwise direction and the positioning portion 432*f* of the hammer setting lever 430 is separated from the hammer 432. Then, by the spring force of the hammer spring 434, the hammer setting lever 430 is rotated in the clockwise direction. Then, the minute zeroing portion 432*a* of the hammer 432 is brought into contact with the minute heart cam 262 of the minute counting wheel 260, the minute counting wheel 260 is zeroed, at the same time, the second zeroing portion 432*b* of the hammer 432 is brought into contact with the second heart cam 220 of the second counting wheel 214 to thereby zero the second counting wheel 214.

According to the above-described reset operation, dimensions and shapes of related parts are determined such that operation of "separating the second counting wheel contact portion 440*a* of the stop lever 440 from the gear of the second counting wheel 214" is completed prior to operation of "zeroing the second counting wheel 214".

That is, in correspondence with the stroke of pushing the reset button 840, the hour hammer transmission lever 510, the hour coupling lever 254 and the hour coupling operation lever 452 are operated, the stop lever 440 is rotated and the second counting wheel contact portion 440*a* is separated from the gear of the second counting wheel 214. Thereafter, by the operation of the hammer transmission lever 520, the hammer setting lever 430 and the hammer setting lever 430, the minute zeroing portion 432*a* of the hammer 432 returns the minute counting wheel 260 to zero and the second zeroing portion 432*b* of the hammer 432 is constituted to return the second counting wheel 214 to zero.

Therefore, the operation of returning the second counting wheel 214 and the minute counting wheel 260 to zero is achieved with certainty without interfering with stopping force of the stop lever 440.

The above-described operation relates to the state in which measurement of the chronograph is stopped. In measurement of the chronograph, the hammer setting lever 430 mounts on the outer peripheral face of the drive teeth 422 and therefore, the chronograph time piece is not reset.

Figure 29:
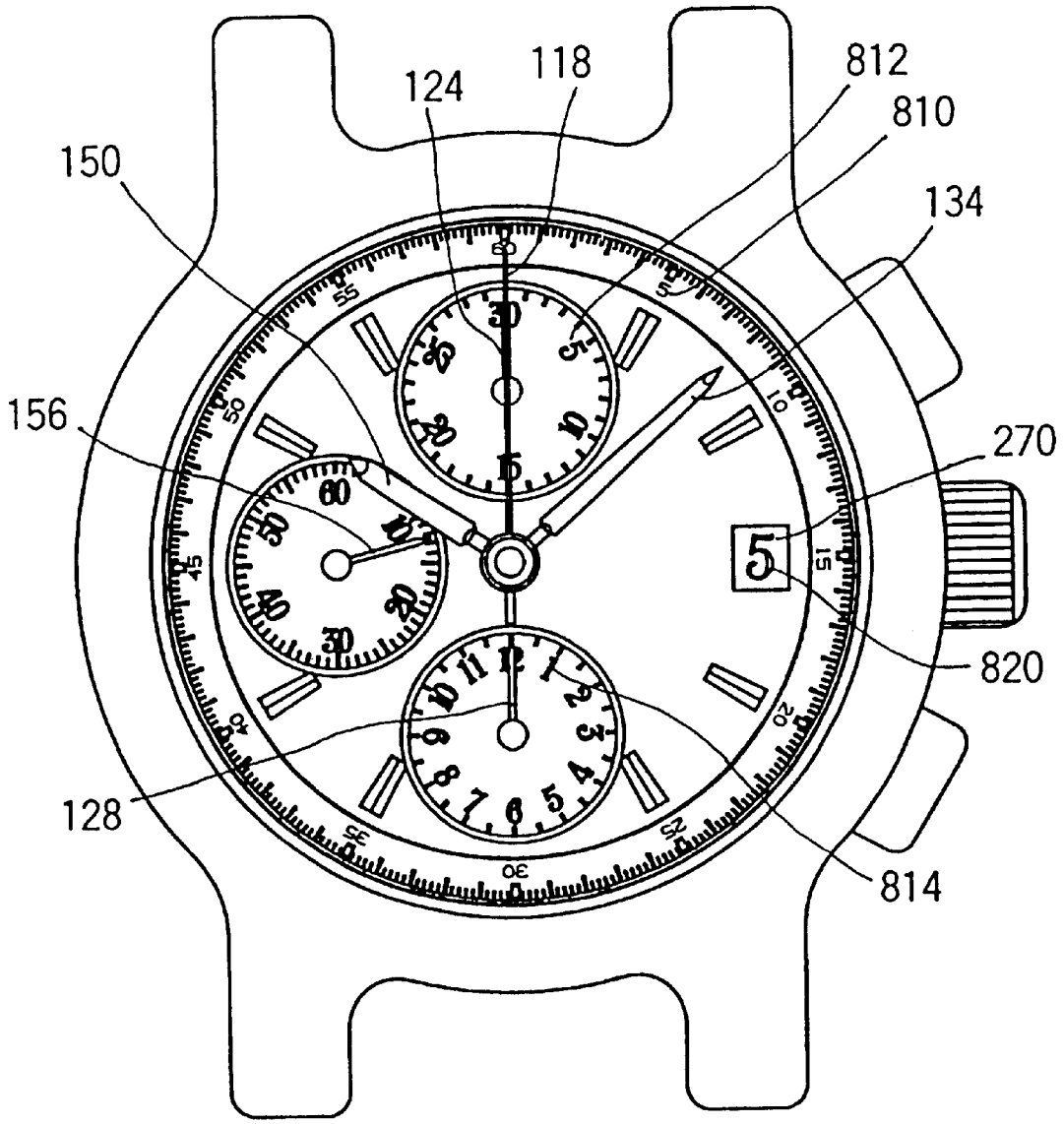
FIG. 29 is a plane view showing an outlook of a chronograph time piece in the state in which the chronograph mechanism is not operated according to the embodiment of the chronograph time piece of the invention.

(3) Explanation of operation of chronograph time piece (3-1) State in which the chronograph mechanism is not operated In reference to FIG. 29, in a state in which the chronograph mechanism is not operated, the hour hand 150 indicates "hour" in current time, the minute hand 134 indicates "minute" in current time and the second hand 156 (so-to-speak small second hand) indicates "second" in current time. The chronograph time piece shown by FIG. 29 displays intermediary time between "10 o'clock 8 minute 12 second" and "10 o'clock 8 minute 13 second".

In this state, the chronograph hour hand 128 is stopped at a position indicating "12", the chronograph minute hand 124 is stopped at a position indicating "30" and the chronograph second hand 118 is stopped in 12 o'clock direction of the time piece, that is, at a position indicating "60".

The chronograph second hand 118 is constituted to rotate by one rotation per minute and chronograph second indicators 810 in correspondence with the chronograph second hand 118 are provided with "5", "10", "15". . . "50", "55" and "160" along the outer periphery of the time piece, that is, along a rotational locus of a front end of the chronograph second hand 118.

As an example, the embodiment of the chronograph time piece according to the invention is constituted to be a time piece of so-to-speak "8 oscillation". "8 oscillation" is referred to as a constitution in which the balance with hairspring makes 28800 sways per hour.

Here, "sway" indicates a state in which the balance with hairspring is rotated in one direction and the balance with hairspring returns to the original position by "2 sways".

That is, in the case of the time piece of "8 oscillation", the balance with hairspring makes 8 sways per second and is oscillated to reciprocate by 4 times per second.

The chronograph time piece may be constituted to be a time piece of so-to-speak "10 oscillation". "10 oscillation" is referred to as a constitution in which the balance with hairspring makes 36000 sways per hour. In the case of the time piece of "10 oscillation", the balance with hairspring makes 10 sways per second and is oscillated to reciprocate 5 times per second.

By constituting in this way, there can be realized a chronograph time piece capable of carrying out chronograph measurement by a unit of "1/10 second". In this constitution, the chronograph second indicators 810 may be provided at every "1/10 second" or the chronograph second indicators 810 may be provided at every "1/5 second".

By constituting in this way, there can be realized a chronograph time piece having high accuracy.

A chronograph time piece may be constituted to be a time piece of so-to-speak "5.5 oscillation" or "6 oscillation". According to these constitutions, the chronograph second indicators 810 are set in conformity with the number of oscillation and the number of teeth of a train wheel is set in conformity with the number of oscillation.

The chronograph minute hand 124 is constituted to rotate by one rotation per 30 minutes and chronograph minute indicators 812 in correspondence with the chronograph minute hand 124 are provided with "5", "10", "15", "20", "25" and "30" along a rotational locus of a front end of the chronograph minute hand 124. The chronograph minute hand 124 may be constituted to rotate by one rotation per 60 minutes.

The chronograph hour hand 128 is constituted to rotate by one rotation per 12 hours and chronograph hour indicators 814 in correspondence with the chronograph hour hand 128 are provided with "1", "2", "3". . . "11" and "12" along a rotational locus of a front end of the chronograph hour hand 128. The chronograph hour hand 128 may be constituted to rotate by one rotation per 24 hours.

A date character 820 of a date indicator 270 displays current date. According to the chronograph time piece shown by FIG. 29, "date of 5" is displayed.

According to the chronograph time piece of the invention, the rotational center of the hour hand 150, the rotational center of the minute hand 134 and the rotational center of the chronograph second hand 118 are arranged substantially at center of the time piece, the rotational center of the second hand 156 (so-to-speak small second hand) is arranged on 9 o'clock side of the time piece, the rotational center of the chronograph minute hand 124 is arranged on 12 o'clock side of the time piece and the rotational center of the chronograph hour hand 128 is arranged on 6 o'clock side of the time piece. Therefore, according to the chronograph time piece of the invention, display of the respective indicator hands is very easy to understand.

(3-2) State in which the chronograph mechanism is operated

Figure 30:
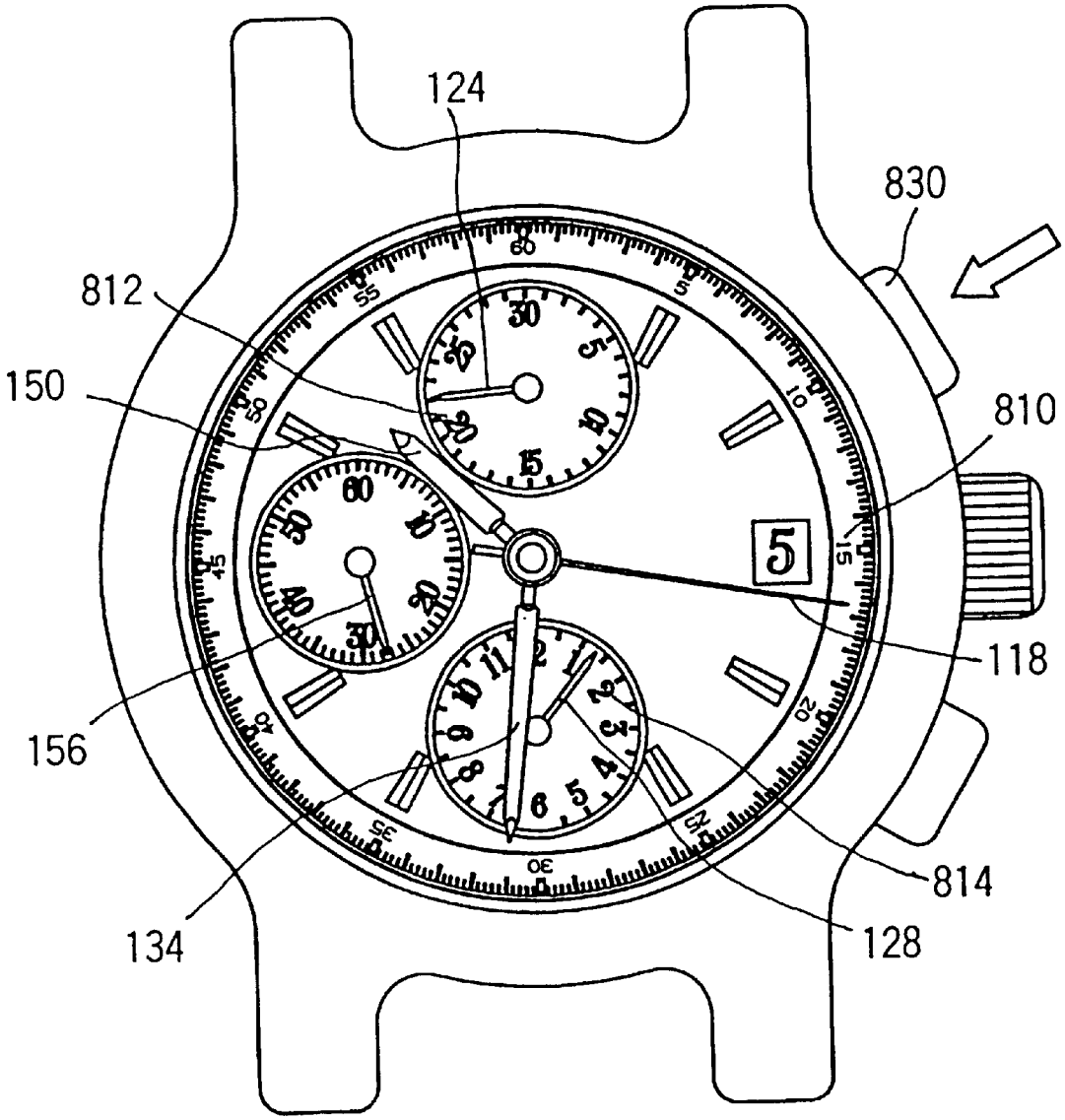
FIG. 30 is a plane view showing the outlook of the chronograph time piece in the state in which the chronograph mechanism is started according to the embodiment of the chronograph time piece of the invention.

In reference to FIG. 30, the start/stop button 830 disposed in 2 o'clock direction of the chronograph time piece is pushed to start the measurement of chronograph.

According to the state shown by FIG. 30, the chronograph hour hand 128 continues rotating while indicating between "1" and "2" of the chronograph time indicators 814, the chronograph minute hand 124 continues rotating while indicating "22" of the chronograph minute indicators 812 and the chronograph second hand 118 continues to rotating while indicating between "16" and "17" of the chronograph second indicators 810.

That is, measurement of the chronograph time piece indicates the moment at which "1 hour 22 minute 16 second 7" has elapsed.

Further, also in such a state, the hour hand 150 indicates "hour" in current time, the minute hand 134 indicates "minute" in current time and the second hand 156 indicates "second" in current time.

(3-3) State in which the chronograph mechanism is stopped

In the state shown by FIG. 30, when the start/stop button 830 disposed in 2 o'clock direction of the chronograph time piece is pushed by one more time, measurement of the chronograph time piece can be stopped. Therefore, the chronograph time piece is brought into a state in which the chronograph is stopped while displaying "1 hour 22 minute 16 second 7".

Further, even in the state, the hour hand 150 indicates "hour" in current time, the minute hand 134 indicates "minute" in current time and the second hand 156 indicates "second" in current time.

(3-4) Operation of reset

Figure 31:
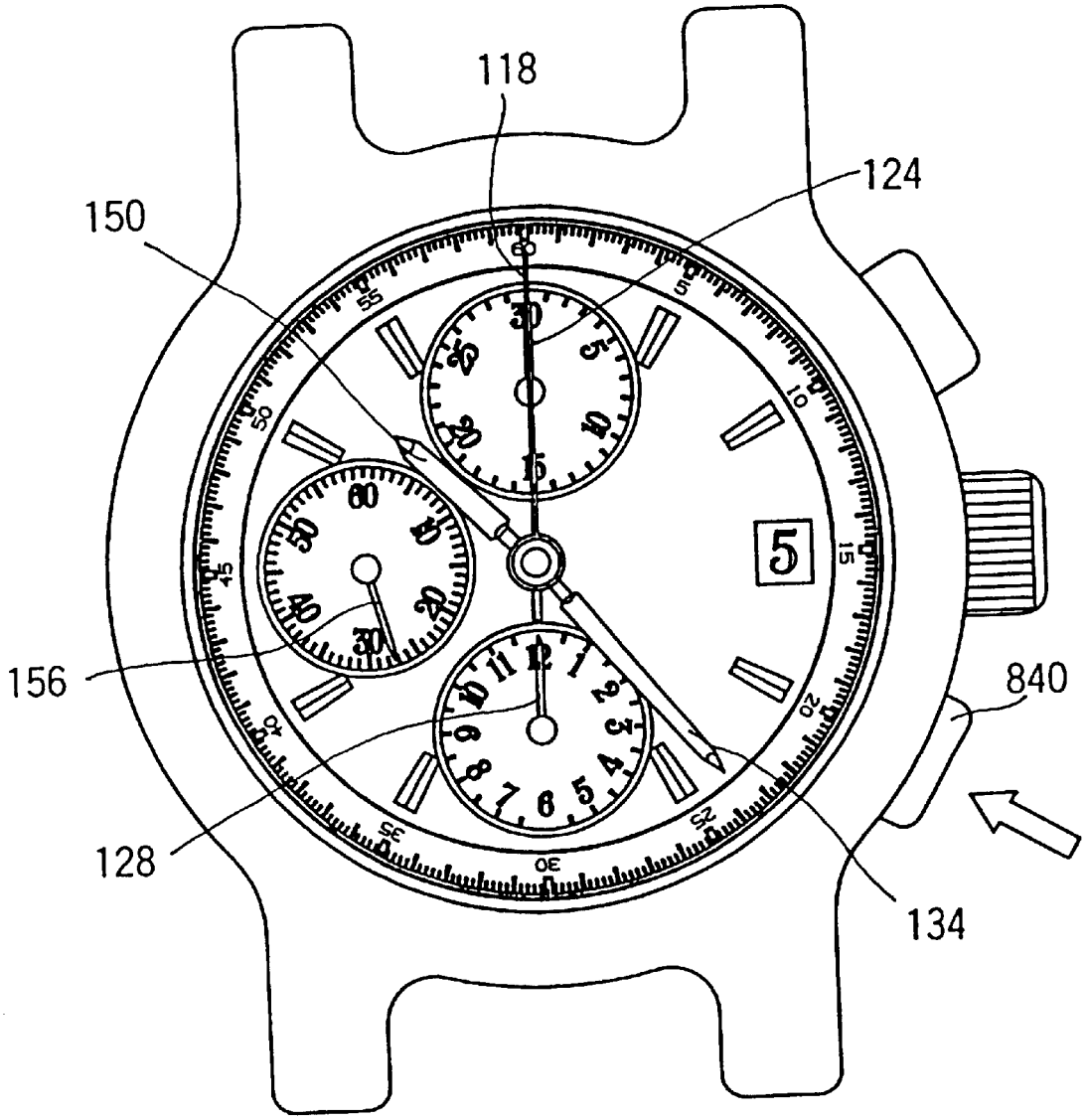
FIG. 31 is a plane view showing the outlook of the chronograph time piece in the state in which operation of the chronograph mechanism is reset according to the embodiment of the chronograph time piece of the invention.
Figure 32:
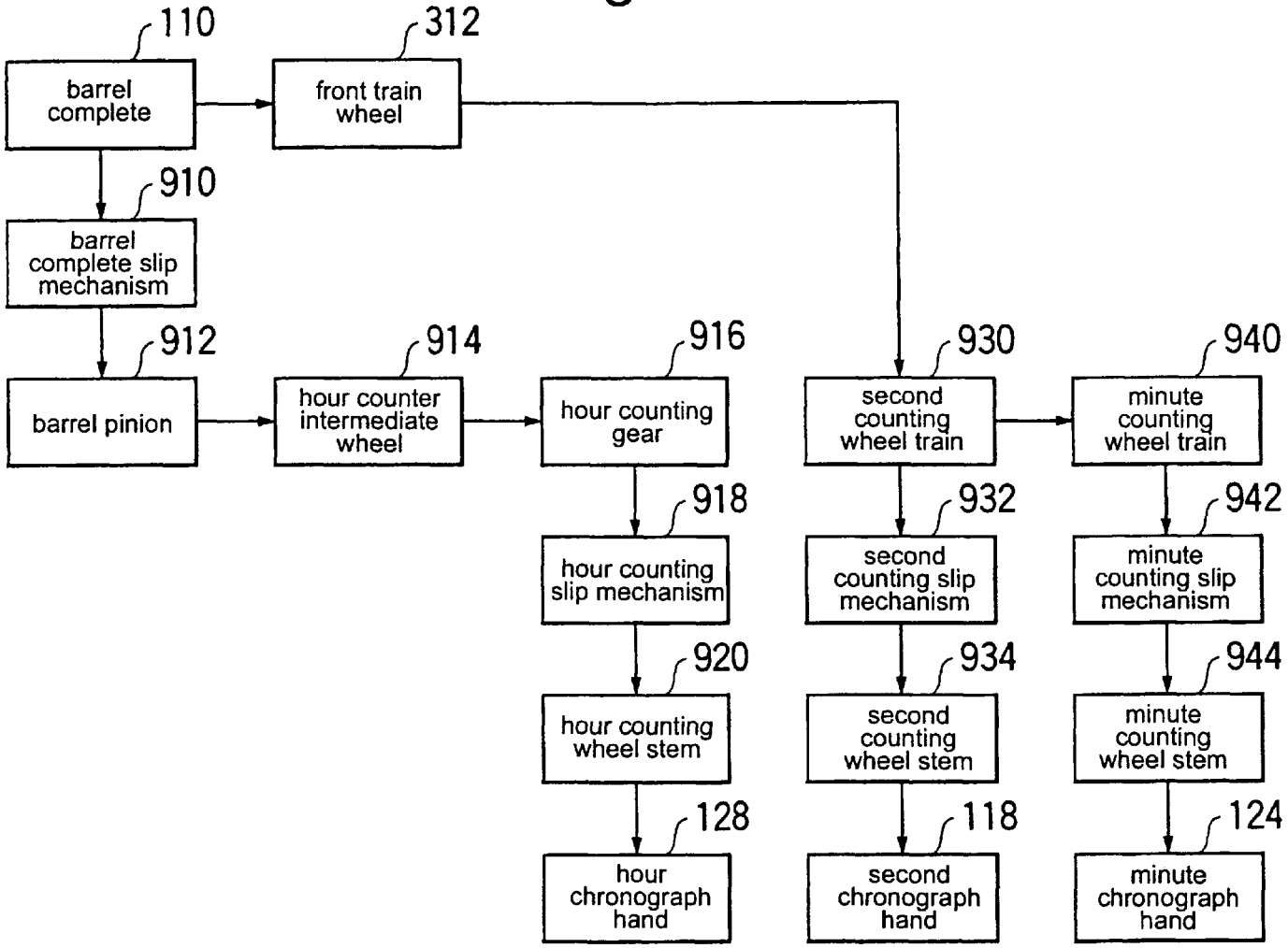
FIG. 32 is a functional block diagram of a conventional chronograph time piece.

In reference to FIG. 31, when the reset button 840 is pushed, the chronograph second hand 118, the chronograph minute hand 124 and the chronograph hour hand 128 return to and stop at "zero positions" which is the previous state of the chronograph mechanism operation.

Further, even in the state, the hour hand 150 indicates "hour" in current time, the minute hand 134 indicates "minute" in current time and the second hand 156 indicates "second" in current time.

Industrial Applicability

As explained above, the invention achieves effects described below since there is constructed the constitution described above in the chronograph time piece.

(1) Structures of the train wheels and the lever apparatus constituting the chronograph mechanism are simple and assembling of the chronograph time piece is facilitated.

(2) Characteristics of the springs used in the chronograph time piece are excellent and accordingly, the chronograph mechanism can be operated with certainty.

(3) There can be realized the lever apparatus for a time piece capable of operating the plurality of levers with certainty.

What is claimed is:

1. A chronograph time piece comprising:

a barrel mounted for undergoing rotation;

a front train wheel for undergoing rotation in accordance with rotation of the barrel;

a second counter intermediate wheel for undergoing rotation in accordance with rotation of the front train wheel;

a second counting wheel for undergoing rotation in accordance with rotation of the second counter intermediate wheel in a chronograph measurement mode;

a chronograph bridge for rotatably supporting an upper shaft portion of the second counting wheel;

a chronograph second display member for displaying a result of measurement of an elapsed time period in seconds in accordance with rotation of the second counting wheel; and a coupling lever for rotatably supporting an upper shaft portion of the second counter intermediate wheel and for preventing rotation of the second counter intermediate wheel from being transmitted to the second counting wheel in a mode in which chronograph measurement is not executed and for transmitting rotation of the second counter intermediate wheel to the second counting wheel in the chronograph measurement mode;

wherein in the mode in which the chronograph measurement is not executed, the coupling lever is not brought into contact with the chronograph bridge, and in the chronograph measurement mode, a portion of the coupling lever is brought into contact with the chronograph bridge.

2. A chronograph time piece according to claim 1; further comprising a minute counting train wheel for undergoing rotation in accordance with rotation of the second counting wheel; and a chronograph minute display member for displaying a result of measurement of an elapsed time period in minutes in accordance with rotation of the minute counting train wheel.

3. A chronograph time piece according to claim 2; further comprising at least one hour counting train wheel for undergoing rotation in accordance with rotation of the barrel in the chronograph measurement mode; and a chronograph hour display member for displaying a result of measurement of an elapsed time period in hours in accordance with rotation of the hour counting train wheel.

4. A chronograph time piece according to claim 3; further comprising a center wheel & pinion for undergoing rotation in accordance with rotation of the barrel; a third wheel & pinion for undergoing rotation in accordance with rotation of the center wheel & pinion; a second wheel for undergoing rotation in accordance with rotation of the third wheel & pinion; a second display member for undergoing rotation in accordance with rotation of the second wheel for displaying time in seconds; a minute transmission pinion for undergoing rotation in accordance with rotation of the center wheel & pinion; a minute drive wheel for undergoing rotation in accordance with rotation of the minute transmission pinion; a minute display member for undergoing rotation in accordance with rotation of the minute drive wheel for displaying time in minutes; an hour wheel for undergoing rotation in accordance with rotation of the minute transmission pinion; and an hour display member for undergoing rotation in accordance with rotation of the hour wheel for displaying time in hours.

5. A chronograph time piece according to claim 2; wherein the coupling lever has a guide frame for rotatably supporting the upper shaft portion of the counter intermediate wheel; and wherein in the chronograph measurement mode, an outer peripheral portion of the guide frame is brought into contact with the chronograph bridge to determine a position of the coupling lever relative to the chronograph bridge and thereby bring the second counter intermediate wheel and the second counting wheel in mesh with each other.

6. A chronograph time piece for measuring elapsed time periods in seconds, minutes and hours in a chronograph measurement mode, the chronograph time piece comprising:

a main plate;

a barrel mounted on the main plate for undergoing rotation;

a second counting wheel for measuring an elapsed time period in seconds in accordance with rotation of the barrel in a chronograph measurement mode;

a minute counting train wheel for measuring an elapsed time period in minutes in accordance with rotation of the barrel in the chronograph measurement mode;

a pair of hour counting train wheels for measuring an elapsed time period in hours in accordance with rotation of the barrel in the chronograph measurement mode;

a chronograph second display member for displaying a result of measurement of the elapsed time period in seconds in accordance with rotation of the second counting wheel;

a chronograph minute display member for displaying a result of measurement of the elapsed time period in minutes in accordance with rotation of the minute counting train wheel;

a chronograph hour display member for displaying a result of measurement of the elapsed time period in hours in accordance with rotation of the hour counting train wheel;

an operating lever mounted on the main plate for undergoing sliding movement;

an operating cam for undergoing rotation in one direction in accordance with sliding movement of the operating lever, the operating cam having a plurality of ratchet teeth engaging the operating lever and having a plurality of drive teeth, the number of ratchet teeth being twice as many as the number of drive teeth; and a stop lever mounted for undergoing rotation to stop rotation of the second counting wheel by rotating the drive teeth of the operating cam in a mode in which chronograph measurement is not executed.

7. A chronograph time piece according to claim 6; further comprising a second counter intermediate wheel for undergoing rotation in accordance with rotation of the barrel, the second counting wheel undergoing rotation in accordance with rotation of the second counter intermediate wheel in the chronograph measurement mode; and a coupling lever operated by rotation of the stop lever for preventing rotation of the second counter intermediate wheel from being transmitted to the second counting wheel in the mode in which the chronograph measurement is not executed and for transmitting rotation of the second counter intermediate wheel to the second counting wheel in the chronograph measurement mode.

8. A chronograph time piece according to claim 7; further comprising an hour coupling operation lever for undergoing rotation in accordance with rotation of the stop lever; and an hour coupling lever for undergoing rotation in accordance with rotation of the hour coupling operation lever; wherein in the mode in which chronograph measurement is not executed, the hour coupling lever sets the rotation of a gear of the hour counting train wheel and in the chronograph measurement mode, the hour coupling lever permits rotation of the gear of the hour counting train wheel.

9. A chronograph time piece according to claim 8; wherein the hour coupling operation lever is disposed on a first side of the main plate; and wherein the hour coupling lever is disposed on a second side of the main plate opposite the first side; and further comprising an hour coupling operation lever operating pin disposed on the hour coupling operation lever for penetrating from the first side of the main plate to the second side of the main plate; and wherein movement of the hour coupling operation lever operating pin causes an operation of the hour coupling operation lever to be transmitted to the hour coupling lever.

10. A chronograph time piece according to claim 9; further comprising a hammer transmission lever for undergoing rotation to reset the chronograph time piece during a reset operation; a hammer setting lever for undergoing rotation in accordance with rotation of the hammer transmission lever during the reset operation; and a hammer for undergoing rotation in accordance with rotation of the hammer transmission lever and for resetting the chronograph second display member and the chronograph minute display member to zero.

11. A chronograph time piece according to claim 10; further comprising: an hour hammer transmission lever mounted for undergoing rotation and for resetting the chronograph time piece during the reset operation; and an hour hammer for undergoing rotation in accordance with rotation of the hour hammer transmission lever and for resetting the chronograph hour display member to zero.

12. A chronograph time piece according to claim 10; further comprising: an hour hammer transmission lever mounted for undergoing rotation and for resetting the chronograph time piece during the reset operation; and an hour coupling lever for undergoing rotation in accordance with rotation of the hour hammer transmission lever during the reset operation; wherein during the reset operation, the hour coupling operation lever undergoes rotation in accordance with rotation of the hour coupling lever; and wherein during the reset operation, the stop lever undergoes rotation in accordance with rotation of the hour coupling operation lever and is released from engagement with the second counting wheel.

13. A chronograph time piece according to claim 12; wherein during the reset operation, the release of the engagement of the stop lever from the second counting wheel is executed prior to the operation of resetting the chronograph second display member and the chronograph minute display member to zero by the hammer.

14. A chronograph time piece according to claim 12; wherein the operation of the hammer setting lever and the operation of the stop lever are controlled by the rotation of the drive teeth of the operating cam.

15. A lever apparatus for a time piece, the lever apparatus comprising:

an operating lever mounted for undergoing sliding movement;

an operating cam for undergoing rotation in one direction in accordance with sliding movement of the operating lever, the operating cam having a plurality of ratchet teeth engaging the operating lever and a plurality of drive teeth, the number of ratchet teeth being twice as many as the number of drive teeth;

a stop lever for undergoing rotation in accordance with rotation of the drive teeth;

a coupling lever for undergoing rotation in accordance with rotation of the stop lever;

an hour coupling operation lever for undergoing rotation in accordance with rotation of the stop lever; and an hour coupling lever for undergoing rotation in accordance with rotation of the hour coupling operation lever.

16. A lever apparatus according to claim 15; further comprising: a hammer transmission lever mounted for undergoing rotation; a hammer setting lever for undergoing rotation in accordance with rotation of the hammer transmission lever; a hammer for undergoing rotation in accordance with rotation of the hammer transmission lever; an hour hammer for undergoing rotation in accordance with rotation of the hour hammer transmission lever; and an hour coupling lever for undergoing rotation in accordance with rotation of the hour hammer transmission lever; wherein the coupling transmission lever undergoes rotation in accordance with rotation of the hour coupling lever; and wherein rotation of the hammer setting lever and rotation of the stop lever are controlled by the rotation of the drive teeth of the operating cam.

17. A chronograph time piece according to claim 1; further comprising at least one hour counting train wheel for undergoing rotation in accordance with rotation of the barrel in the chronograph measurement mode; and a chronograph hour display member for displaying a result of measurement of an elapsed time period in hours in accordance with rotation of the hour counting train wheel.

18. A chronograph time piece according to claim 1; further comprising a center wheel & pinion for undergoing rotation in accordance with rotation of the barrel; a third wheel & pinion for undergoing rotation in accordance with rotation of the center wheel & pinion; a second wheel for undergoing rotation in accordance with rotation of the third wheel & pinion; a second display member for undergoing rotation in accordance with rotation of the second wheel for displaying time in seconds; a minute transmission pinion for undergoing rotation in accordance with rotation of the center wheel & pinion; a minute drive wheel for undergoing rotation in accordance with rotation of the minute transmission pinion; a minute display member for undergoing rotation in accordance with rotation of the minute drive wheel for displaying time in minutes; an hour wheel for undergoing rotation in accordance with rotation of the minute transmission pinion; and an hour display member for undergoing rotation in accordance with rotation of the hour wheel for displaying time in hours.

19. A chronograph time piece according to claim 1; further comprising a chronograph bridge for rotatably supporting an upper shaft portion of the second counting wheel; wherein the coupling lever rotatably supports an upper shaft portion of the second counter intermediate wheel; and wherein in the mode in which the chronograph measurement is not executed, the coupling lever is not brought into contact with the chronograph bridge while in the chronograph measurement mode, a portion of the coupling lever is brought into contact with the chronograph bridge.

20. A chronograph time piece according to claim 19; wherein the coupling lever has a guide frame for rotatably supporting the upper shaft portion of the counter intermediate wheel; and wherein in the chronograph measurement mode, an outer peripheral portion of the guide frame is brought into contact with the chronograph bridge to determine a position of the coupling lever relative to the chronograph bridge and thereby bring the second counter intermediate wheel and the second counting wheel in mesh with each other.

21. A chronograph time piece according to claim 2; further comprising a center wheel & pinion for undergoing rotation in accordance with rotation of the barrel; a third wheel & pinion for undergoing rotation in accordance with rotation of the center wheel & pinion; a second wheel for undergoing rotation in accordance with rotation of the third wheel & pinion; a second display member for undergoing rotation in accordance with rotation of the second wheel for displaying time in seconds; a minute transmission pinion for undergoing rotation in accordance with rotation of the center wheel & pinion; a minute drive wheel for undergoing rotation in accordance with rotation of the minute transmission pinion; a minute display member for undergoing rotation in accordance with rotation of the minute drive wheel for displaying time in minutes; an hour wheel for undergoing rotation in accordance with rotation of the minute transmission pinion; and an hour display member for undergoing rotation in accordance with rotation of the hour wheel for displaying time in hours.

22. A chronograph time piece according to claim 2; further comprising a chronograph bridge for rotatably supporting an upper shaft portion of the second counting wheel; wherein the coupling lever rotatably supports an upper shaft portion of the second counter intermediate wheel; and wherein in the mode in which the chronograph measurement is not executed, the coupling lever is not brought into contact with the chronograph bridge while in the chronograph measurement mode, a portion of the coupling lever is brought into contact with the chronograph bridge.

23. A chronograph time piece according to claim 22; wherein the coupling lever has a guide frame for rotatably supporting the upper shaft portion of the counter intermediate wheel; and wherein in the chronograph measurement mode, an outer peripheral portion of the guide frame is brought into contact with the chronograph bridge to determine a position of the coupling lever relative to the chronograph bridge and thereby bring the second counter intermediate wheel and the second counting wheel in mesh with each other.

24. A chronograph time piece according to claim 3; further comprising a chronograph bridge for rotatably supporting an upper shaft portion of the second counting wheel; wherein the coupling lever rotatably supports an upper shaft portion of the second counter intermediate wheel; and wherein in the mode in which the chronograph measurement is not executed, the coupling lever is not brought into contact with the chronograph bridge while in the chronograph measurement mode, a portion of the coupling lever is brought into contact with the chronograph bridge.

25. A chronograph time piece according to claim 24; wherein the coupling lever has a guide frame for rotatably supporting the upper shaft portion of the counter intermediate wheel; and wherein in the chronograph measurement mode, an outer peripheral portion of the guide frame is brought into contact with the chronograph bridge to determine a position of the coupling lever relative to the chronograph bridge and thereby bring the second counter intermediate wheel and the second counting wheel in mesh with each other.

26. A chronograph time piece according to claim 6; further comprising an hour hammer transmission lever mounted for undergoing rotation and for resetting the chronograph time piece during the reset operation; and an hour hammer for undergoing rotation in accordance with rotation of the hour hammer transmission lever and for resetting the chronograph hour display member to zero.

27. A chronograph time piece according to claim 7; further comprising an hour hammer transmission lever mounted for undergoing rotation and for resetting the chronograph time piece during the reset operation; and an hour hammer for undergoing rotation in accordance with rotation of the hour hammer transmission lever and for resetting the chronograph hour display member to zero.

28. A chronograph time piece according to claim 8; further comprising an hour hammer transmission lever mounted for undergoing rotation and for resetting the chronograph time piece during the reset operation; and an hour hammer for undergoing rotation in accordance with rotation of the hour hammer transmission lever and for resetting the chronograph hour display member to zero.

29. A chronograph time piece according to claim 9; further comprising an hour hammer transmission lever mounted for undergoing rotation and for resetting the chronograph time piece during the reset operation; and an hour hammer for undergoing rotation in accordance with rotation of the hour hammer transmission lever and for resetting the chronograph hour display member to zero.

30. A chronograph time piece according to claim 9; further comprising an hour hammer transmission lever mounted for undergoing rotation and for resetting the chronograph time piece during the reset operation; and an hour coupling lever for undergoing rotation in accordance with rotation of the hour hammer transmission lever during the reset operation; wherein during the reset operation, the hour coupling operation lever undergoes rotation in accordance with rotation of the hour coupling lever; and wherein during the reset operation, the stop lever undergoes rotation in accordance with rotation of the hour coupling operation lever and is released from engagement with the second counting wheel.

31. A chronograph time piece according to claim 10; wherein the operation of the hammer setting lever and the operation of the stop lever are controlled by the rotation of the drive teeth of the operating cam.

32. A chronograph time piece according to claim 10; wherein the operation of the hammer setting lever and the operation of the stop lever are controlled by the rotation of the drive teeth of the operating cam.

33. A chronograph time piece according to claim 11; wherein the operation of the hammer setting lever and the operation of the stop lever are controlled by the rotation of the drive teeth of the operating cam.

* * * * *